US006126298A

United States Patent [19]

Wu

[11] Patent Number: 6,126,298

[45] Date of Patent: Oct. 3, 2000

[54] SUPPORT STRUCTURE FOR DECORATIVE LIGHTING STRING CIRCUITS

[76] Inventor: Jeng-Shyong Wu, No. 14, Alley 1, Lane 326, Shyr-Piin Road, Hsin-Chu City, Taiwan

[21] Appl. No.: 09/151,843

[22] Filed: Sep. 11, 1998

[51] Int. Cl.[7] ..... F21L 1/00

[52] U.S. Cl. ..... 362/252; 362/227; 362/249; 362/806; 362/808; 362/391

[58] Field of Search ..... 362/159, 161, 362/808, 806, 391, 249, 250, 252

[56] References Cited

U.S. PATENT DOCUMENTS

| | | | |
|---|---|---|---|
| 4,241,387 | 12/1980 | Bowers . | |
| 4,769,749 | 9/1988 | Felski . | |
| 5,057,976 | 10/1991 | DuMong . | |
| 5,213,409 | 5/1993 | Fisher . | |
| 5,424,925 | 6/1995 | Jenke et al. | 362/123 |
| 5,534,315 | 7/1996 | Witte | 428/7 |
| 5,601,361 | 2/1997 | Lawrence | 362/238 |
| 5,662,409 | 9/1997 | Huang . | |
| 5,944,408 | 8/1999 | Tong et al. . | |

OTHER PUBLICATIONS

Mirriam–Webster's Collegiatte Dictionary, 10th Edition; Merriam–Webster, Incorporated; Springfield Massachusetts; 1996.

*Primary Examiner*—Sandra O'Shea
*Assistant Examiner*—Ismael Negron
*Attorney, Agent, or Firm*—McGlew and Tuttle, P

[57] ABSTRACT

A support structure for a Christmas lighting string includes a lamp bulb, lamp base, lamp holder, multiple electrical conductors, receptacles, flasher control and non-electrical conductor. The electrical conductors, lamp base and lamp holder can be connected in series, parallel, or series and parallel to form a complete circuit of the lighting strings. Non-electrical connectors and electrical conductors are connected or wound. The non-electrical connectors are simultaneously or individually fixed with the electrical conductors by knots. Thus the lamp bulbs are limited in proper spaced intervals so as to form a certain appearance, design or words and to obtain a decorative effect.

56 Claims, 27 Drawing Sheets

54
12
11
55
5

1
5
55
55
54

SUPPORT STRUCTURE FOR DECORATIVE LIGHTING STRING CIRCUITS

BACKGROUND OF THE INVENTION

A conventional lamp socket device in a Christmas lighting string is consisting of a lamp bulb, lamp base, lamp holder, multiple electrical conductors, receptacles or flasher control, wherein the electrical conductors can be single or double or more than two to wind into an electrical circuit. The contribution conductors can be formed in one, two or more than two electrical conductors, such as the FIG. 4 of U.S. Pat. No. 4,241,387 and the prior art FIGS. 1 and 2 in this case In general, it is to use said electrical conductors to be wound in the trees. Such is troublesome and monotonous. Further, such kind of work is used several years. The recent development is to form a net light. The conventional use is a lamp holder being equipped with a fastener or to use a fastening ring to fix the electrical conductors on the lamp holder; or to use fastening ring to bundle the multiple electrical conductors together, such as the structures in U.S. Pat. Nos. 4,769,749, 5,057,976, 5,213,409 or 5,662,409 and so on. However, such structures are still unable to reach an ideal effect. The present invention is an improvement in the defects of the conventional products. It is to use non-electrical connectors, in which their size, color and appearance similar to the electrical conductors, to be connected, wound and knotted with the electrical conductors and limited to the position of the lamp bulbs or lamp holders. Thus, it is able to form every appearance, design or words so as to obtain a decorative effect.

SUMMARY OF THE INVENTION

Accordingly, it is an object of the present invention to provide an electrical circuit distribution structure for a Christmas lighting string to form a certain appearance, design or words and to obtain a decorative effect.

Another object is to provide with the use of non-electrical connectors being simultaneously or individually fixed with electrical conductors by making knots so as to form a certain appearance, design or words and to obtain a decorative effect.

Other objects and features will become apparent when the description of preferred embodiments is taken in conjunction with the annexed drawings.

DETAILED DESCRIPTION OF THE PREFERRED EMBODIMENTS

Figure 1:
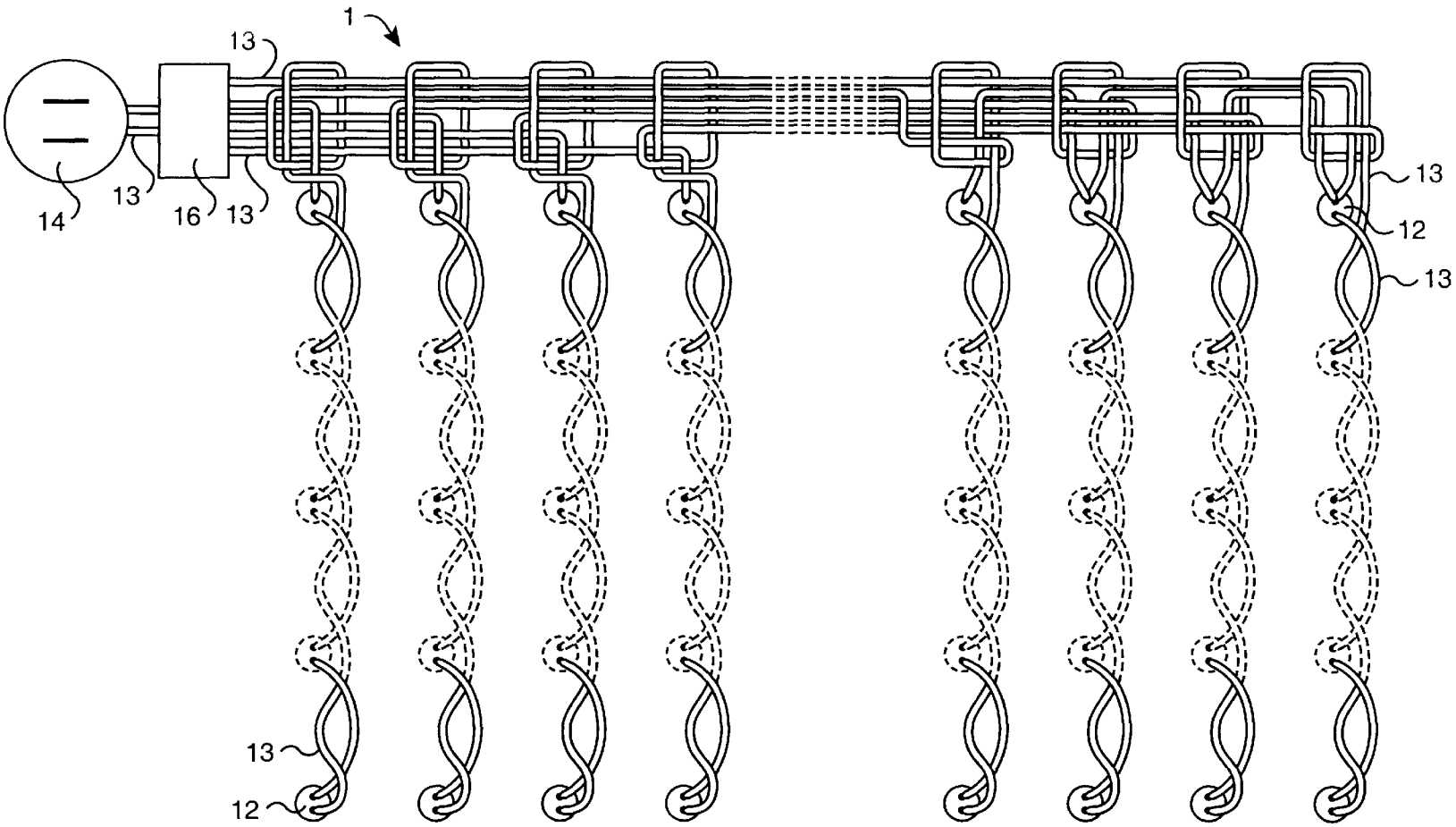
FIG. 1 (PRIOR ART)
FIG. 1 is an embodiment of an electrical circuit distribution structure in a conventional lighting string.

For the explanatory purpose, same reference numbers are used to indicate the same parts of components in the drawings.

Referring now to the drawings and in particular to FIG. 1, it is an embodiment of an electrical circuit distribution structure of a conventional lighting string 1 consisting of lamp bulb 12, electrical or line 13, attachment plug 14 and flasher control 16. The electrical conductors 13 are winding to form a linear and vertical type to be called as curtain light.

Figure 2:
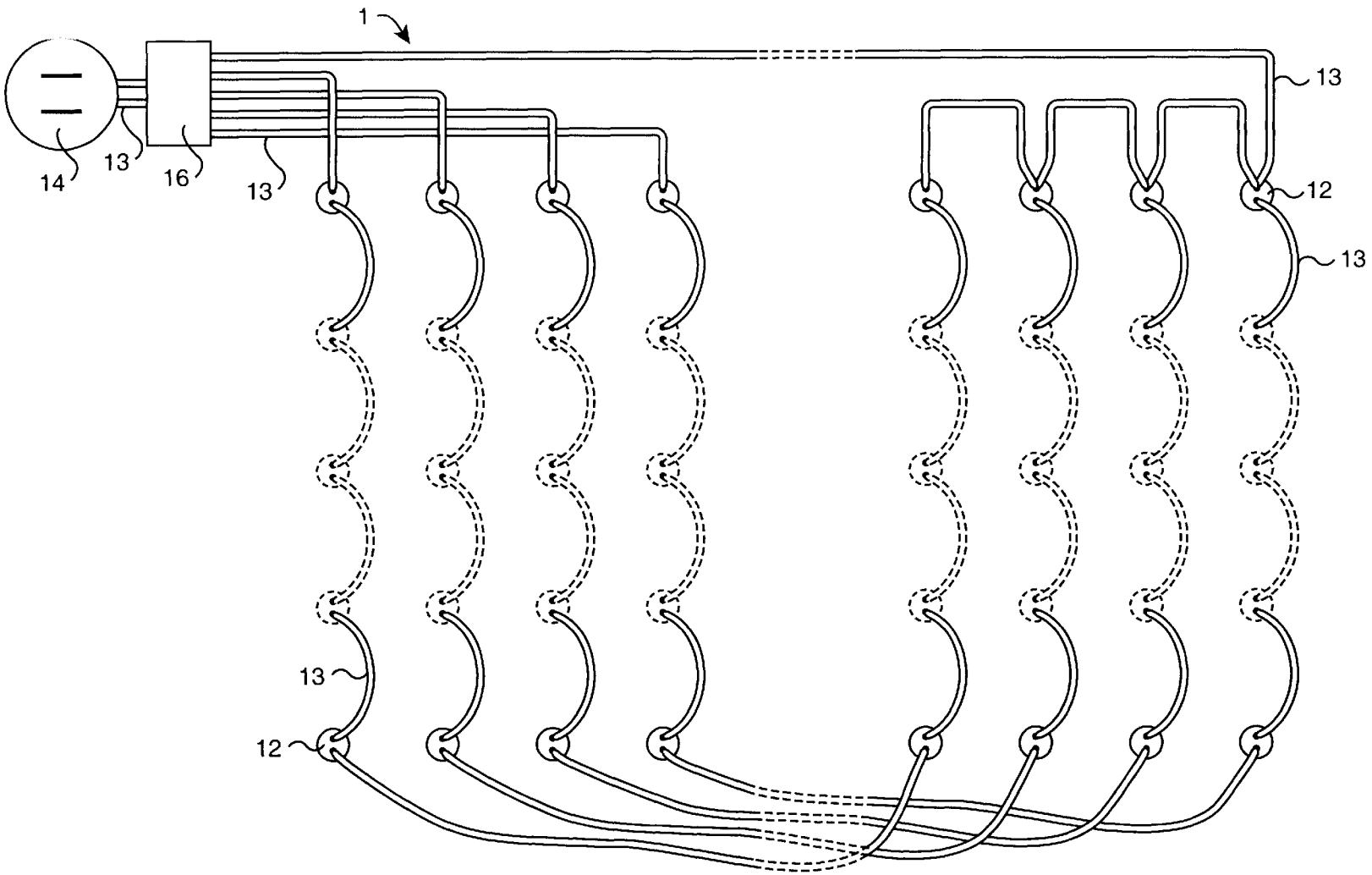
FIG. 2 (PRIOR ART)
FIG. 2 is a further embodiment of an electrical circuit distribution structure in a conventional lighting string.

FIG. 2 is a further embodiment of an electrical circuit distribution structure of a conventional lighting string 1 consisting of lamp bulb 12, electrical conductor 13, attachment plug 14 and flasher control 16. The electrical conductor 13 is winding to string together to form a lighting string.

Figure 3:
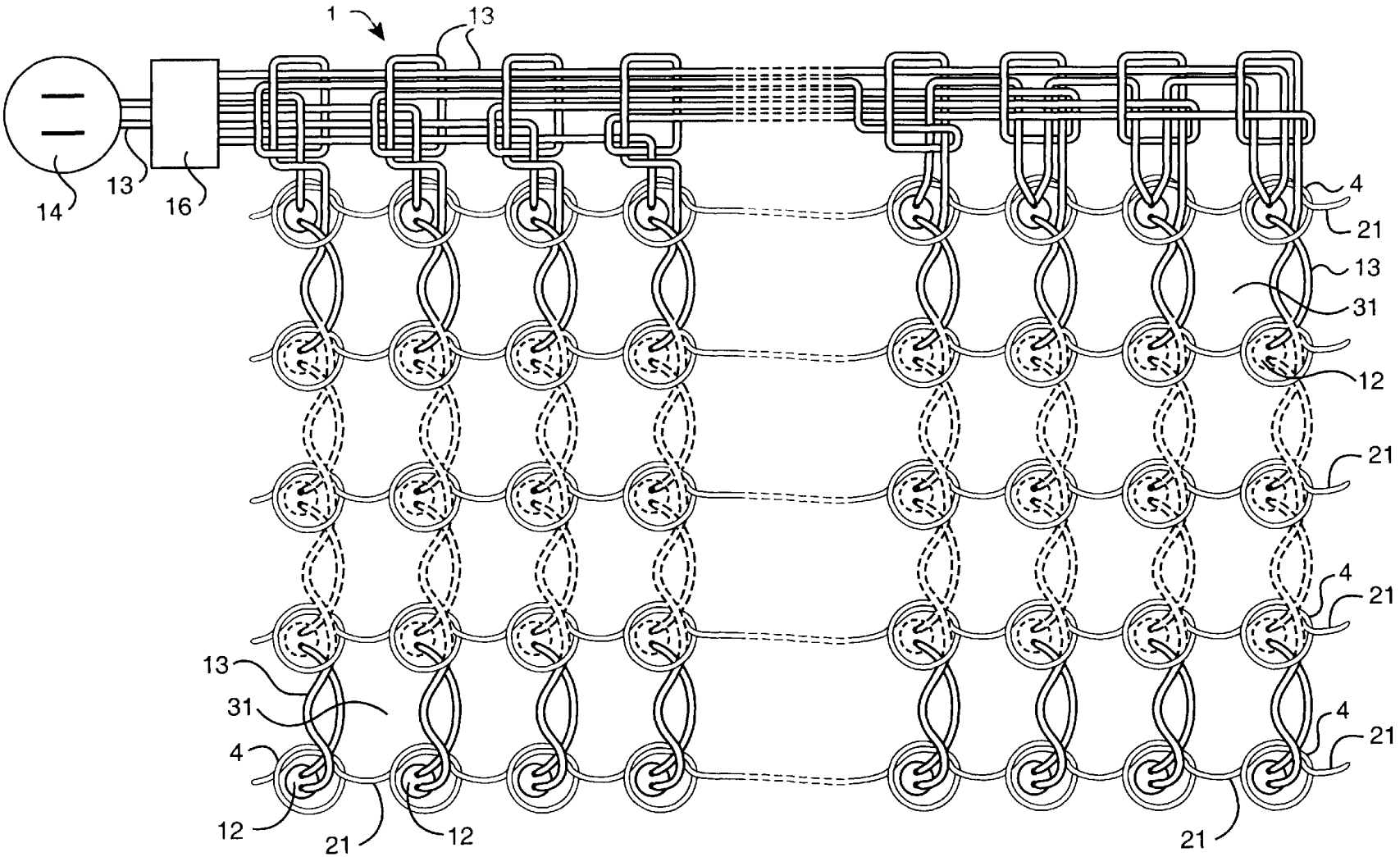
FIG. 3 is an embodiment of an electrical circuit distribution structure in rectangular or square unit to form a large design of the present invention.

According to the electrical circuit distribution structure in FIG. 3, the lighting string 1 and electrical circuit are identical with those of in FIG. 1. It is to use non-electrical conductors which is not to wind wind with the electrical connectors or line, at the horizontal direct ion making the knots 4 between the lamp base or lamp holder 12 and electrical conductors 13 in order. The distances in each line and row are about identical and per four lamp bulbs or lamp bases or lamp holders 12 are formed into square or rectangular units 31. Each unit is connected to for square shaped decoration.

Figure 4:
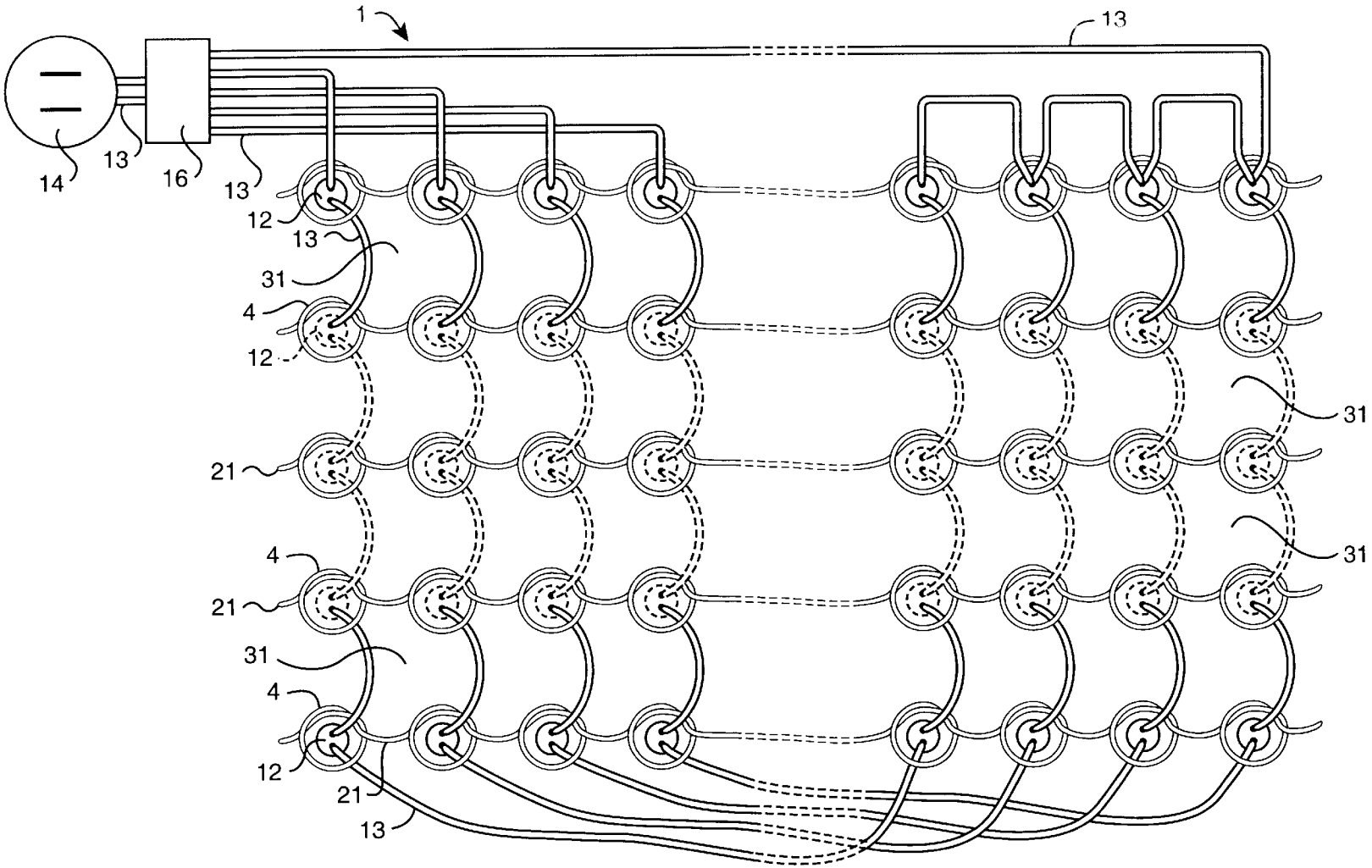
FIG. 4 is a further embodiment of an electrical circuit distribution structure in rectangular or square unit to form a large design of the present invention.

According to the electrical circuit distribution structure in FIG. 4, the lighting string 1 and electrical circuit are identical with those of in FIG. 2. It is to use non-electrical conductors which is not to wind wind with the electrical connectors, at the horizontal direction making the knots 4 between the lamp base or lamp holder 12 and electrical conductors 13 in order. The distances in each line and row are about identical and per four lamp bulbs or lamp bases or lamp holders 12 are formed into square or rectangular units 31. Each unit is connected to for square shaped decoration.

Figure 5:
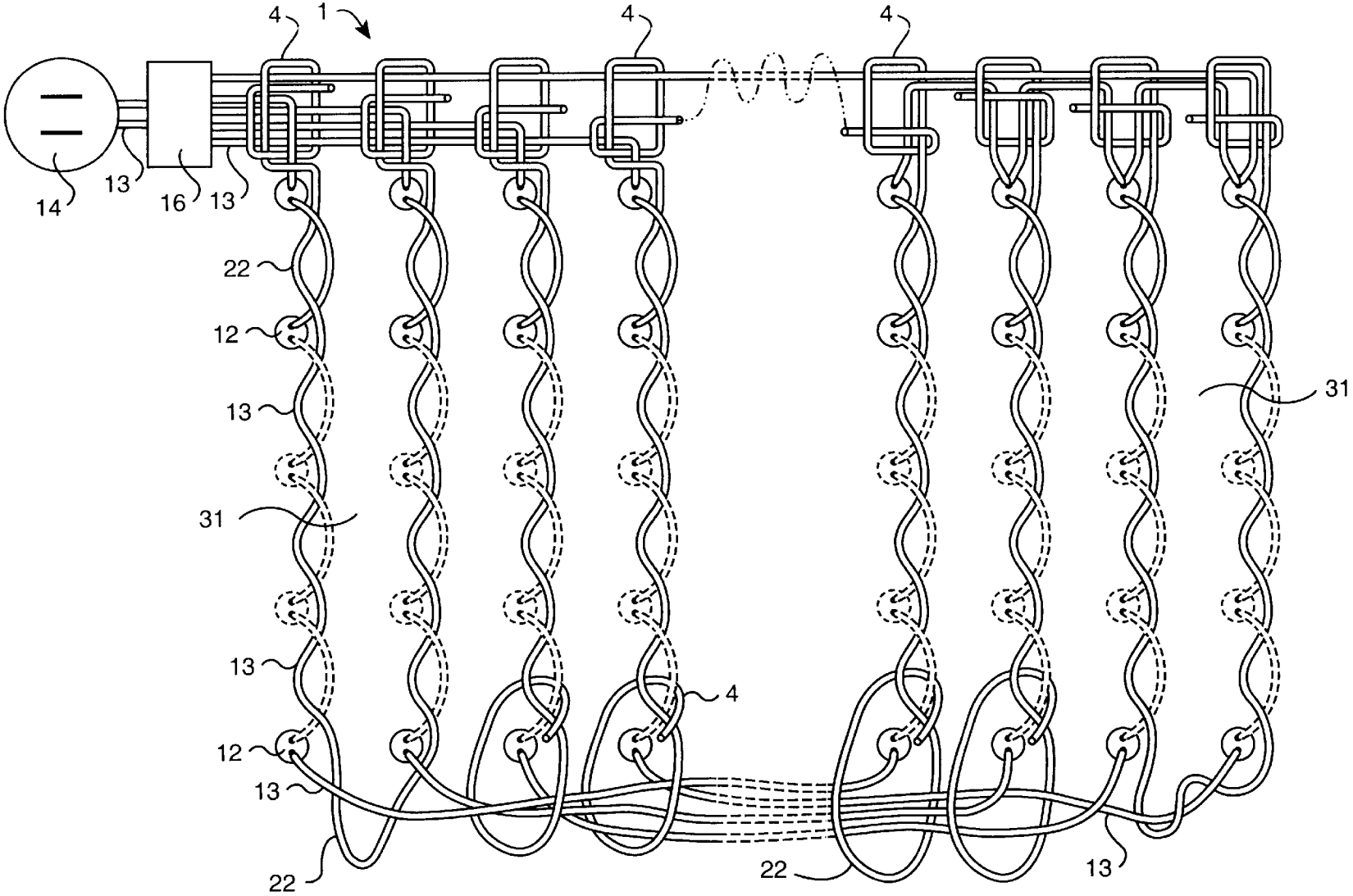
FIG. 5 is an embodiment of an electrical circuit distribution structure in rectangular unit to form a large design of the present invention.

According to the electrical circuit distribution structure in FIG. 5, the lighting string 1 and electrical circuit are identical with those of in FIG. 2. It is to use non-electrical conductors 21 which is not to wind with the electrical conductors, winding with one line electrical conductor 13 into a similar structure of twisted conductor, and said non-electrical conductor 22 which is to wind with electrical conductors, at the end of electrical conductor 13 making a knot 4 for fixation, and between the multiple lamp bulbs or lamp bases or lamp holders 12 to form rectangular units 31. Each unit is connected to for square shaped decoration.

Figure 6:
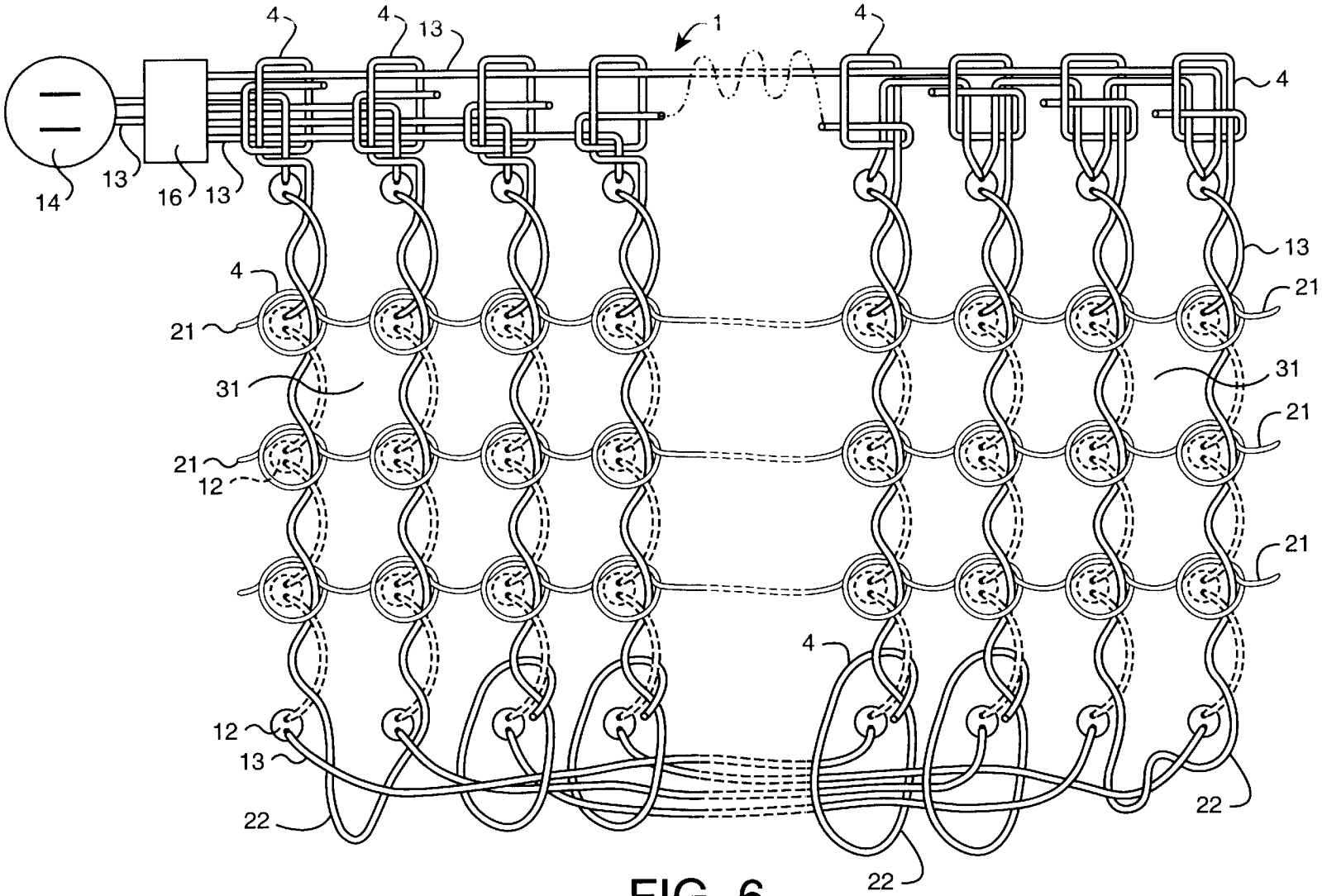
FIG. 6 is another embodiment of an electrical circuit distribution structure in rectangular or square unit to form a large design of the present invention.

According to the electrical circuit distribution structure in FIG. 6, the lighting string 1, electrical circuit and to use non-electrical connectors 22 to form the rectangular units are identical with those of in FIG. 5. Further, it is to use non-electrical 21 which is not to wind wind with the electrical conductors, at the horizontal direction making the knots 4 between the lamp base or lamp holder 12 and electrical conductors 13 in order. The distances in each line and row are about identical and per four lamp bulbs or lamp bases or lamp holders 12 are formed into square units 31. Each unit is connected to for square shaped decoration.

Figure 7:
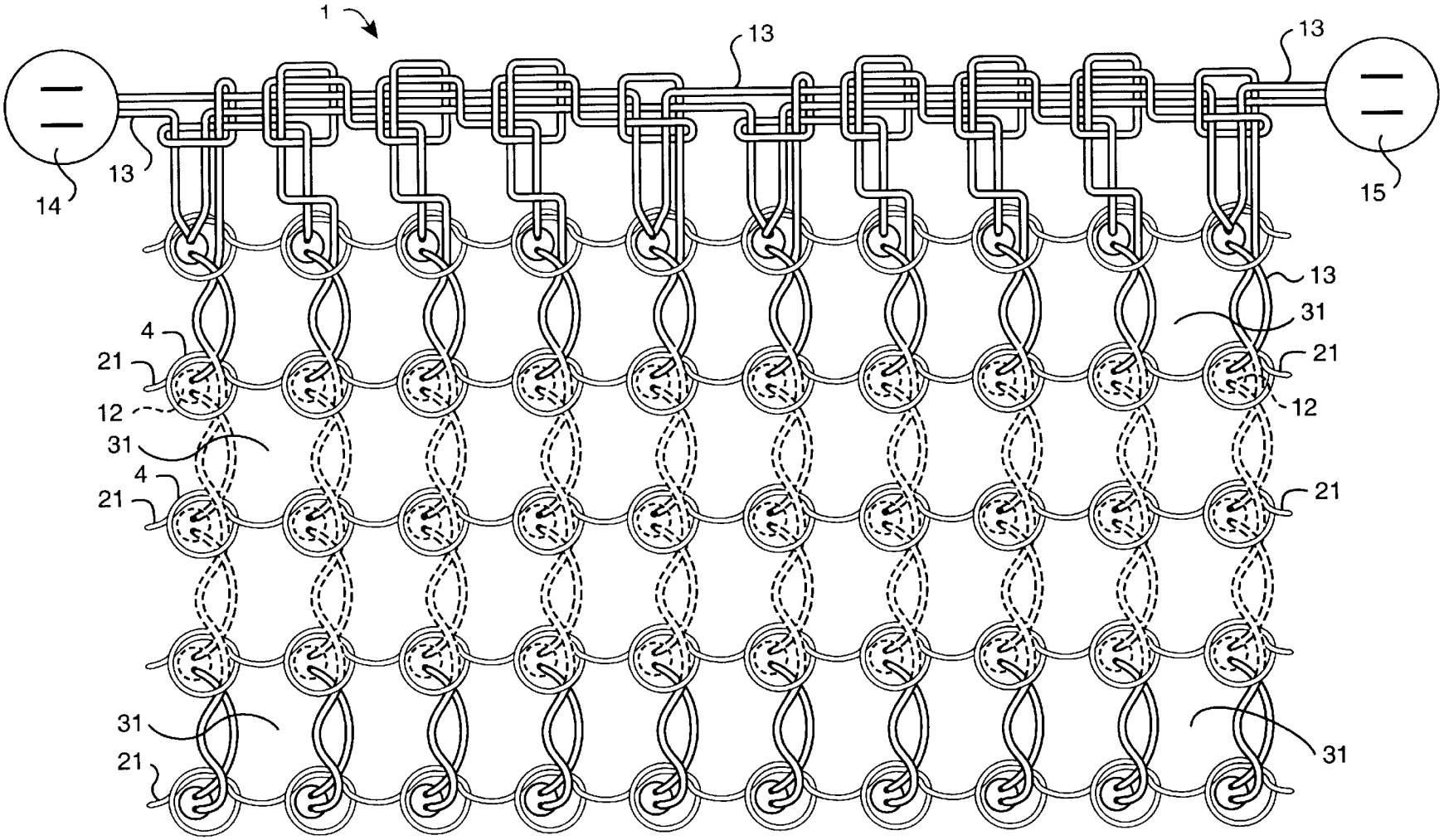
FIG. 7 is a still further embodiment of an electrical distribution structure in rectangular or square unit to form a large design of the present invention.

According to the electrical circuit distribution structure in FIG. 7, the lighting string 1 is consisting of lamp bulbs, lamp bases or lamp holder 12, electrical conductors 13, attachment plug 14 and cord connector body 15 are used to form parallel and series lighting strings. The electrical conductors 13 are winding to form a linear and vertical type. It is to use non-electrical connectors which is not to wind wind with the electrical conductors, at the horizontal direction making the knots 4 between the lamp base or lamp holder 12 and electrical conductors 13 in order. The distances in each line and row are about identical and per four lamp bulbs or lamp bases or lamp holders 12 are formed into square or rectangular units 31. Each unit is connected to for square shaped decoration.

Figure 8:
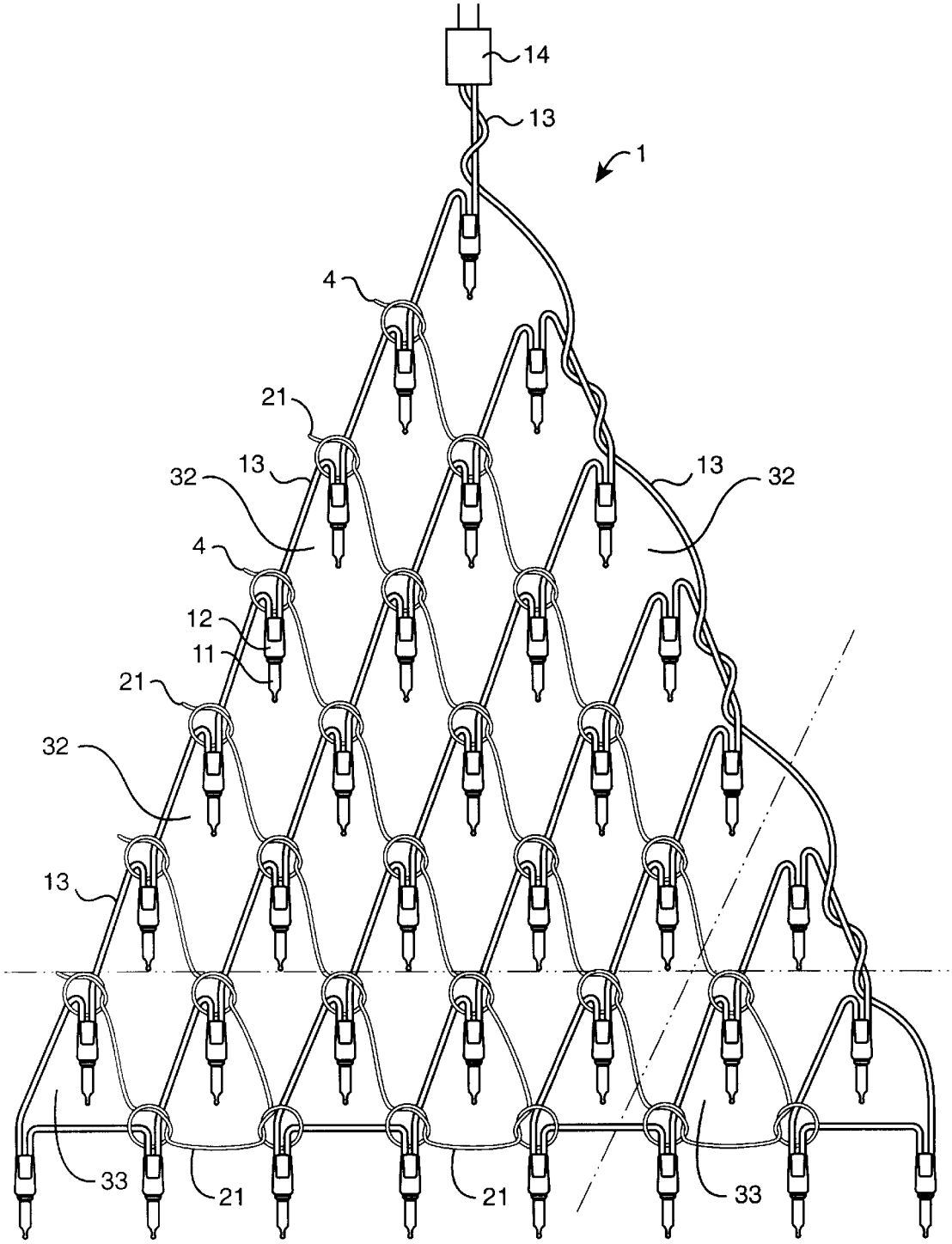
FIG. 8 is an embodiment of an electrical circuit distribution structure in rhombic or triangular unit to form a pyramid design of the present invention.

According to the electrical circuit distribution structure in FIG. 8 the lighting string 1 is consisting of lamp bulbs 11, lamp bases or lamp holder 12, electrical conductors 13, attachment plug 14 and cord connector body 15 are used to form one line connection of lighting strings. Firstly, the bulbs are arranged in rows in the inclined direction. It is to use non-electrical connectors 21 which is not to wind wind with the electrical conductors, at another inclined direction making the knots 4 between the lamp bases or lamp holders 12 and electrical conductors 13 in order. The distances in each lamp bulb 11 and lamp base or lamp holder 12 are about identical and per four lamp bulbs 1 or lamp bases or lamp holders 12 are formed into rhombic units 32. In the lowest bottom, per three lamp bulbs 11 and lamp bases or lamp holders 12 are formed into triangular units 33. Each unit is connected to form pyramid shaped decoration.

Figure 9:
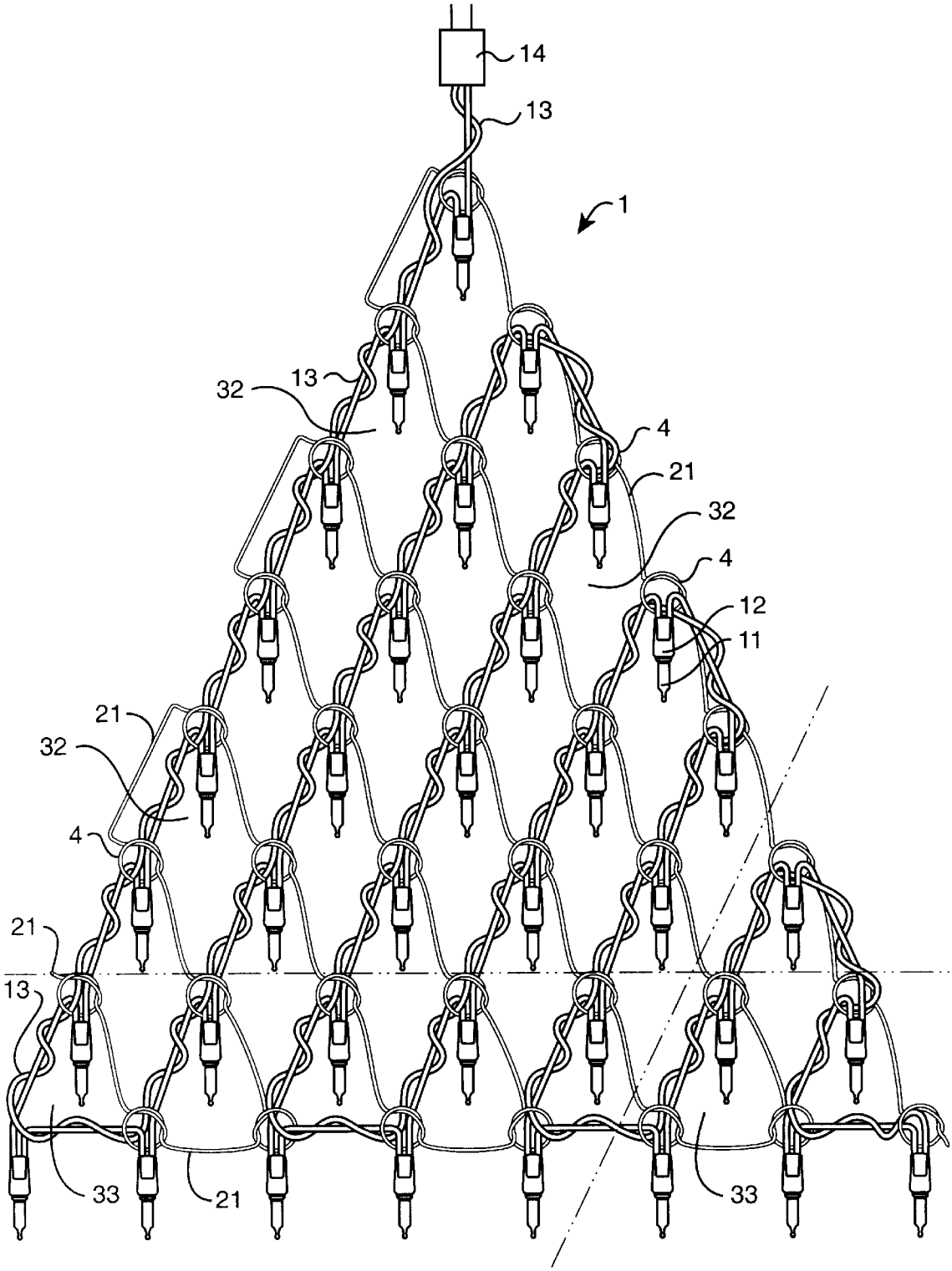
FIG. 9 is a further embodiment of an electrical circuit distribution structure in rhombic or triangular unit to form a pyramid design of the present invention.

According to the electrical circuit distribution structure in FIG. 9, the lighting string 1 is consisting of lamp bulbs 11, lamp bases or lamp holder 12, electrical conductors 13, attachment plug 14 and cord connector body 15 are used to form two lines connection of lighting strings. Firstly, the bulbs are arranged in rows in the inclined direction. It is to use non-electrical connectors 21 which is not to wind wind with the electrical conductors, at another inclined direction making the knots 4 between the lamp bases or lamp holders 12 and electrical conductors 13 in order. The distances in each lamp bulb 11 and lamp base or lamp holder 12 are about identical and per four lamp bulbs or lamp bases or lamp holders 12 are formed into rhombic units 32. In the lowest bottom, per three lamp bulbs 11 and lamp bases or lamp holders 12 are formed into triangular units 33. Each unit is connected to form pyramid shaped decoration.

Figure 10:
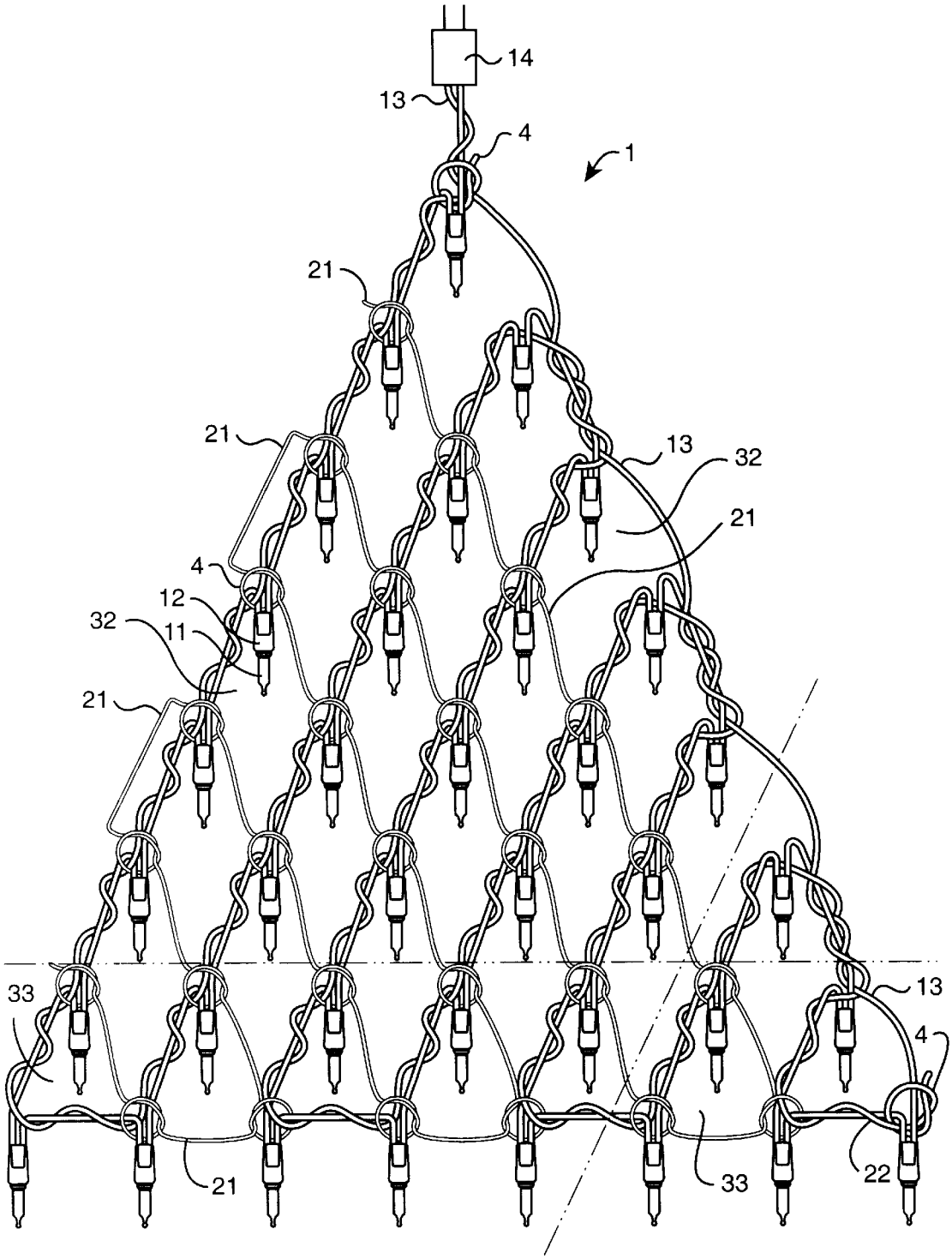
FIG. 10 is another embodiment of an electrical circuit distribution structure in rhombic or triangular unit to form a pyramid design of the present invention.

According to the electrical circuit distribution structure in FIG. 10, the lighting string 1 and electrical circuit are identical with those of in FIG. 8. It is to use non-electrical connectors 22 which is to wind with the electrical conductors, winding with one line electrical conductor 13 into a similar structure of twisted connector. Said non-electrical conductor 22 at the end of electrical conductor 13 is making a knot 4 for fixation. Firstly, the bulbs are arranged in rows in the inclined direction. It is to use non-electrical connectors 21 which is not to wind wind with the electrical conductors, at another inclined direction making the knots 4 between the lamp bases or lamp holders 12 and electrical conductors 13 in order. The distances in each lamp bulb 11 and lamp base or lamp holder 12 are about identical and per four lamp bulbs 11 or lamp bases or lamp holders 12 are formed into rhombic units 32. In the lowest bottom, per three lamp bulbs 11 and lamp bases or lamp holders 12 are formed into triangular units 33. Each unit is connected to form pyramid shaped decoration.

Figure 11:
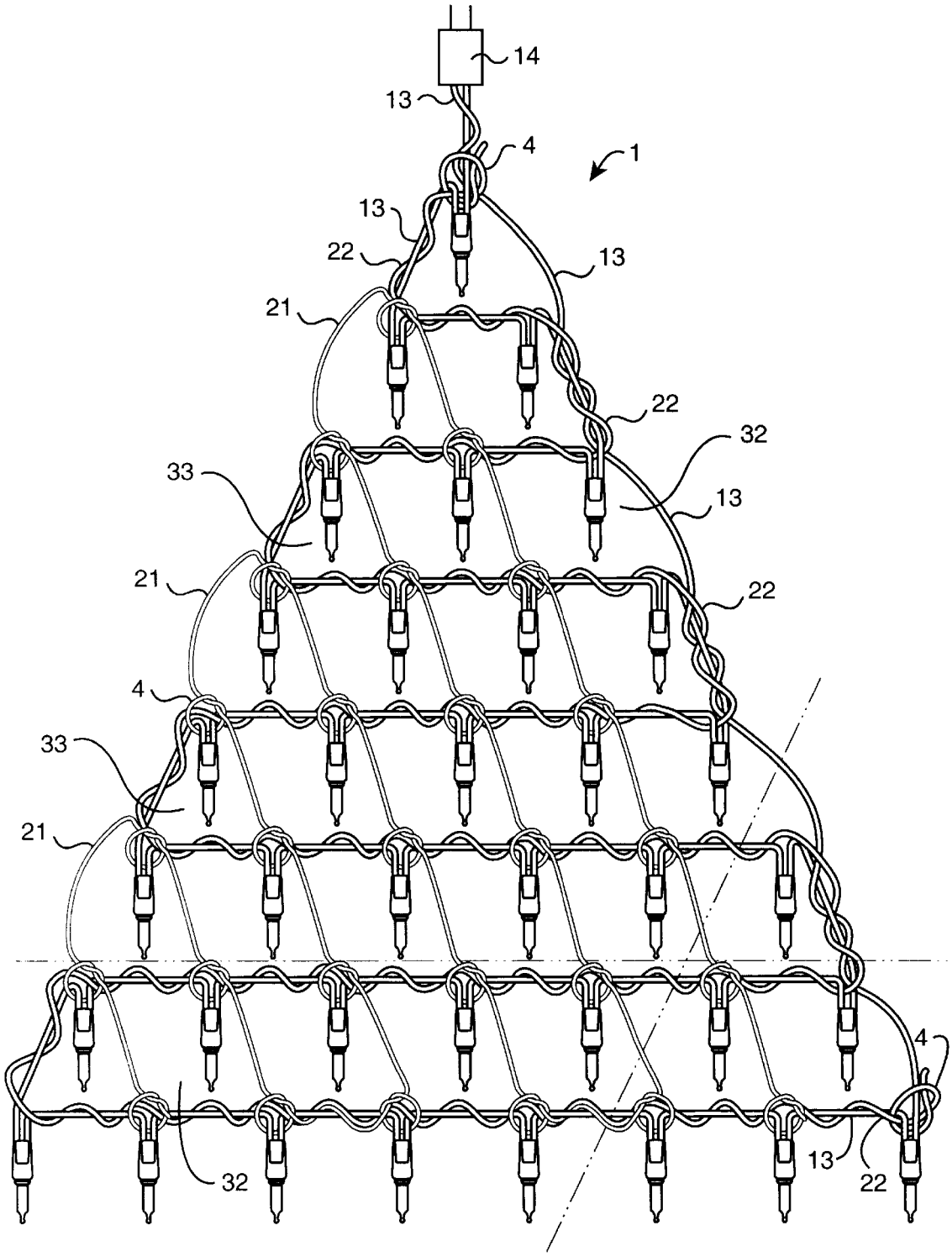
FIG. 11 is a still further embodiment of an electrical circuit distribution structure in rhombic or triangular unit to form a pyramid design of the present invention.

According to the electrical circuit distribution structure in FIG. 11, the lighting string 1 and electrical circuit are identical with those of in FIG. 8. It is to use non-electrical connectors 22 which is to wind with the electrical conductors, winding with one line electrical conductor 13 into a similar structure of twisted conductor. Said non-electrical conductor 22 at the end of electrical connector 13 is making a knot 4 for fixation. Firstly, the bulbs are arranged in parallel rows. It is to use non-electrical connectors 21 which is not to wind wind with the electrical conductors, at the inclined direction making the knots 4 between the lamp bases or lamp holders 12 and electrical conductors 13 in order. The distances in each lamp bulb 11 and lamp base or lamp holder 12 are about identical and per four lamp bulbs 11 or lamp bases or lamp holders 12 are formed into rhombic units 32. In the lowest bottom, per three lamp bulbs 11 and lamp bases or lamp holders 12 are formed into triangular units 33. Each unit is connected to form pyramid shaped decoration.

Figure 12:
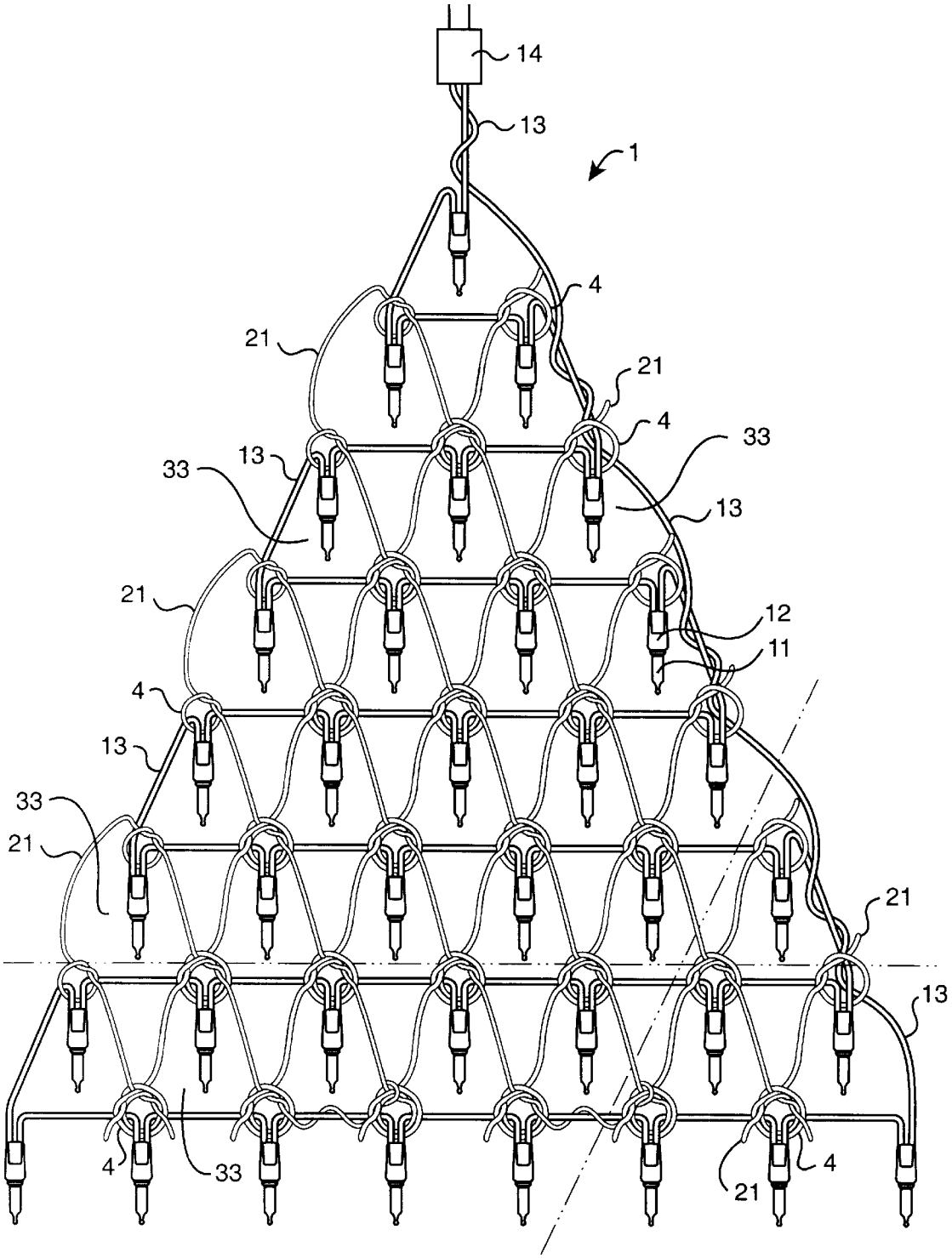
FIG. 12 is an embodiment of an electrical circuit distribution structure in triangular unit to form a pyramid design of the present invention.

According to the electrical circuit distribution structure in FIG. 12, the lighting string 1 and electrical circuit are identical with those of in FIG. 8. Firstly, the bulbs are arranged in parallel rows. It is to use non-electrical connectors 21 which is not to wind wind with the electrical conductors, at the right or left inclined direction making the knots 4 between the lamp bases or lamp holders 12 and electrical conductors 13 in order. The distances in each lamp bulb 11 and lamp base or lamp holder 12 are about identical and per three lamp bulbs 11 or lamp bases or lamp holders 12 are formed into triangular units 33. Each unit is connected to form pyramid shaped decoration.

Figure 13:
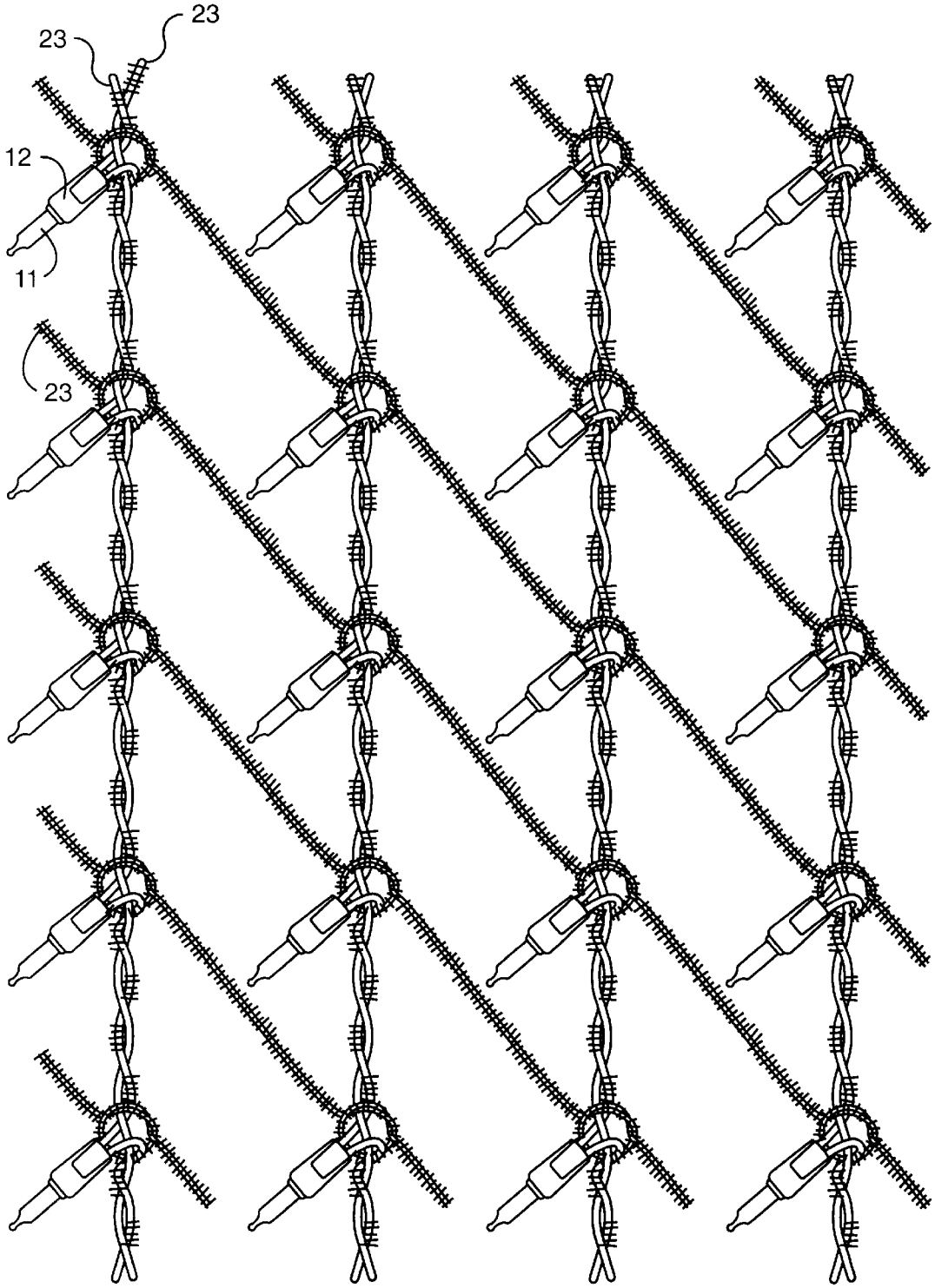
FIG. 13 is an embodiment of an electrical circuit distribution structure to use attached decoration of non-electrical connectors of the present invention.
Figure 14:
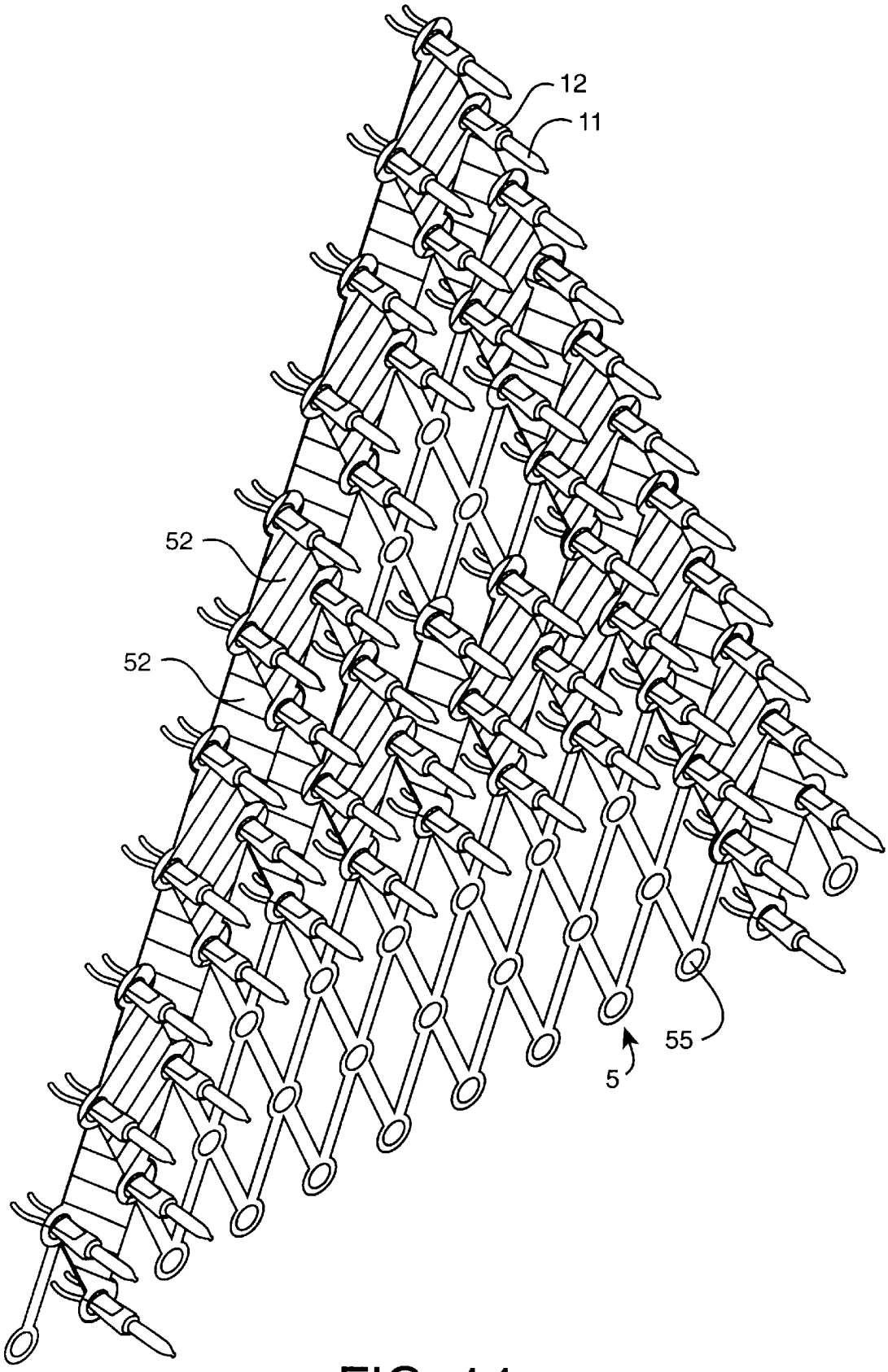
FIG. 14 is an embodiment of an electrical circuit distribution structure in rhombic unit to form an A-type design of the present invention.
Figure 14A:
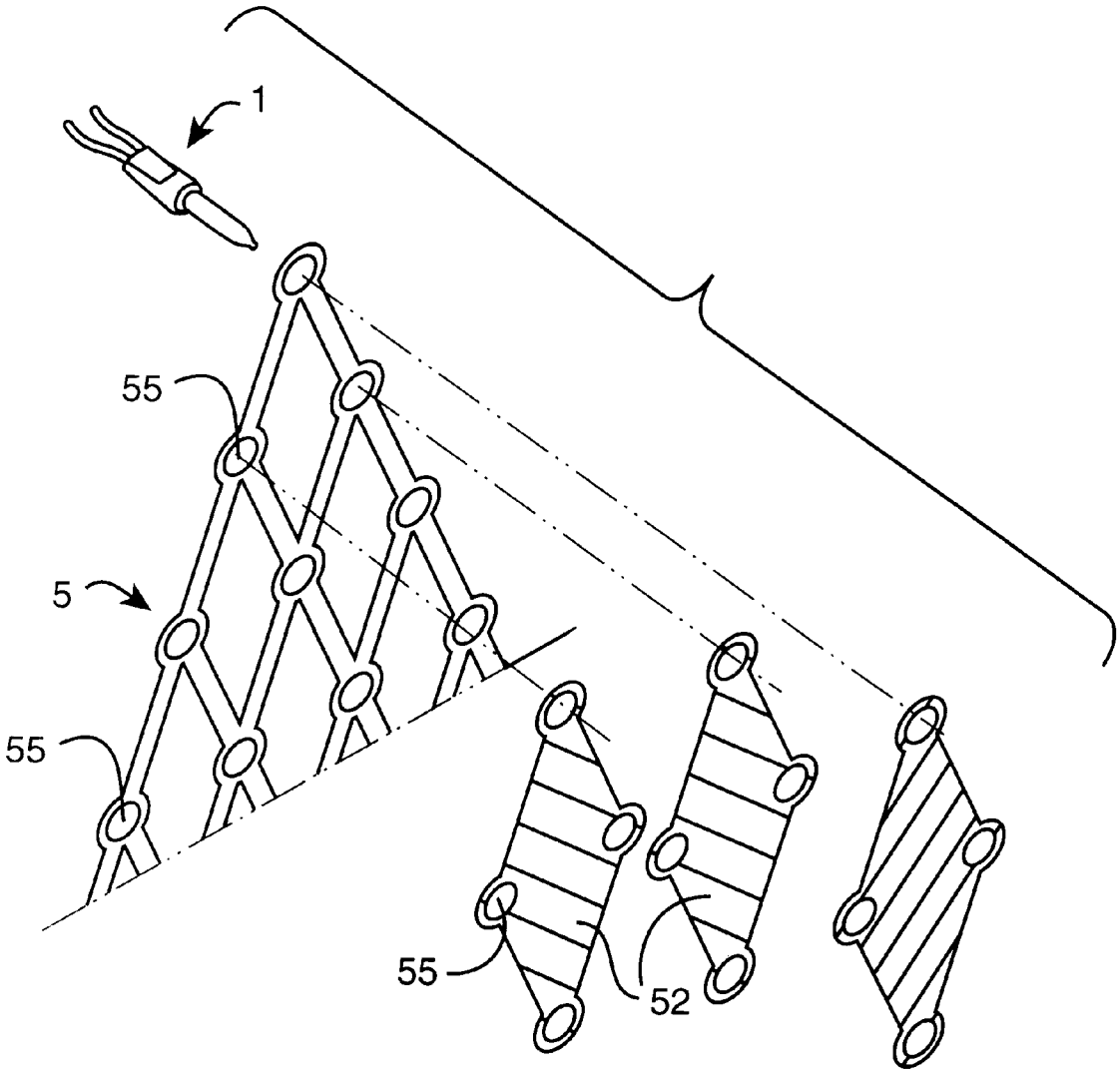
FIG. 14A is a partial diagram of distribution.
Figure 15:
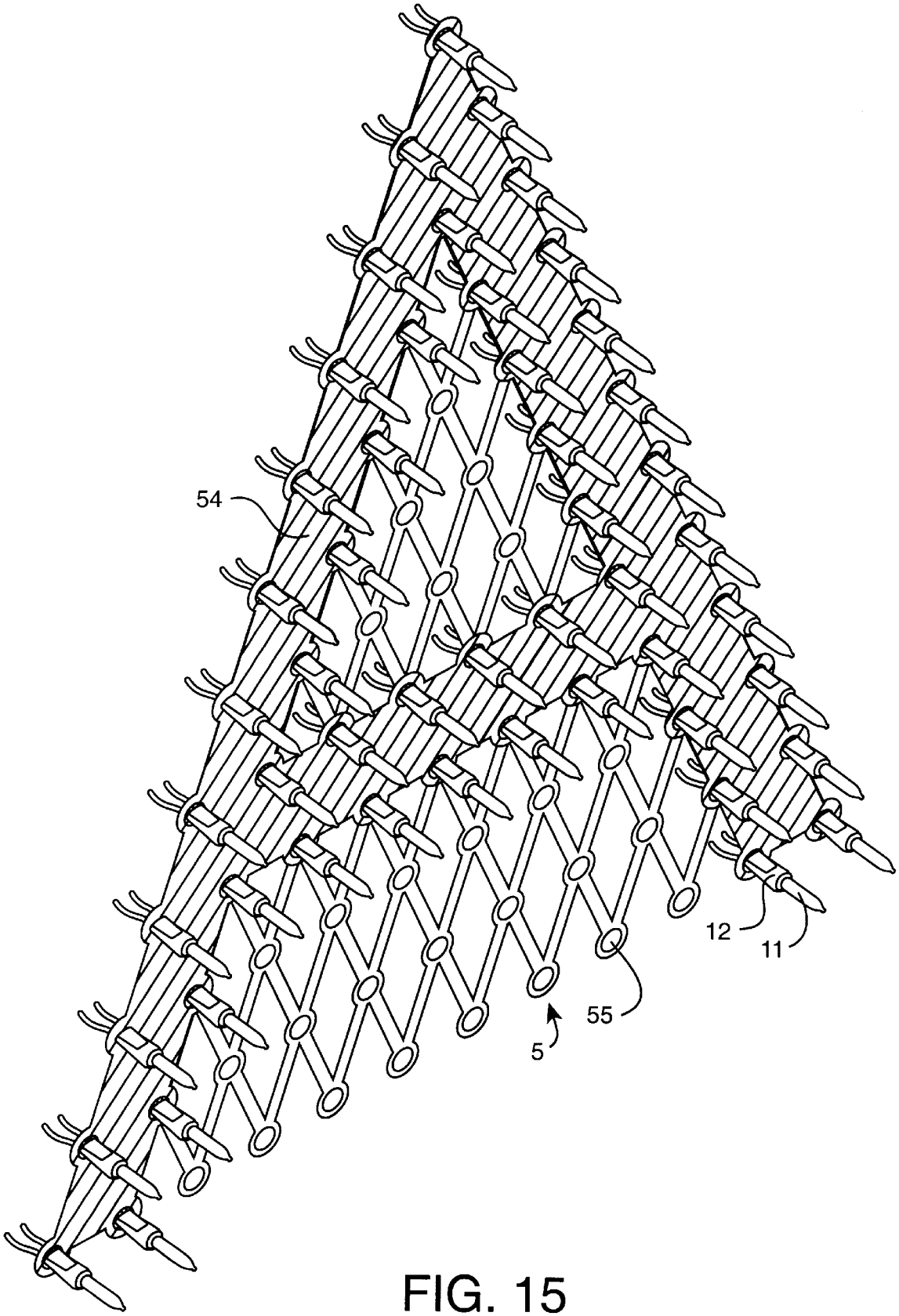
FIGS. 15–15A is a further embodiment of an electrical circuit distribution structure in rhombic unit to form an A-type design of the present invention.
Figure 15A:
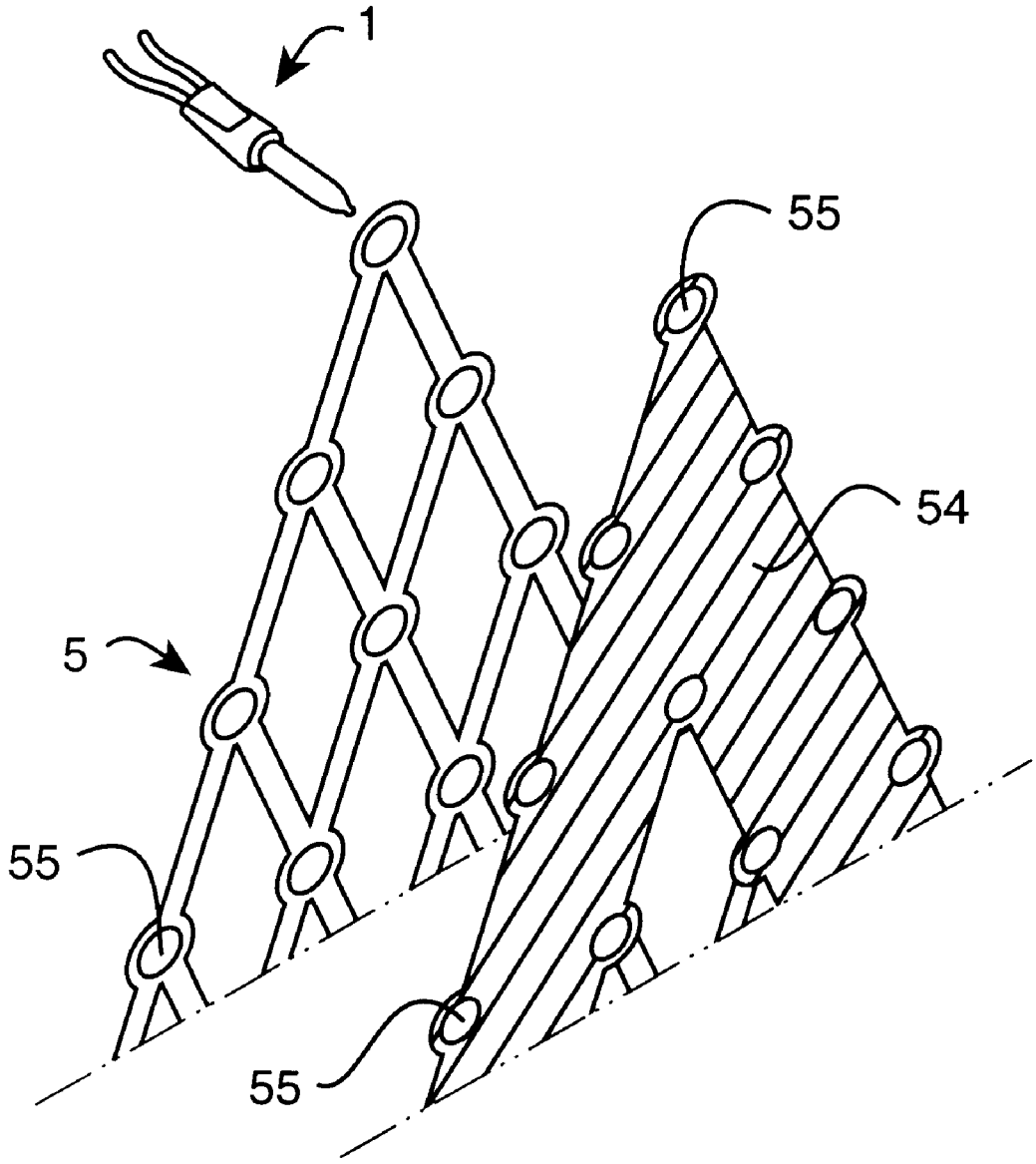
Figure 16:
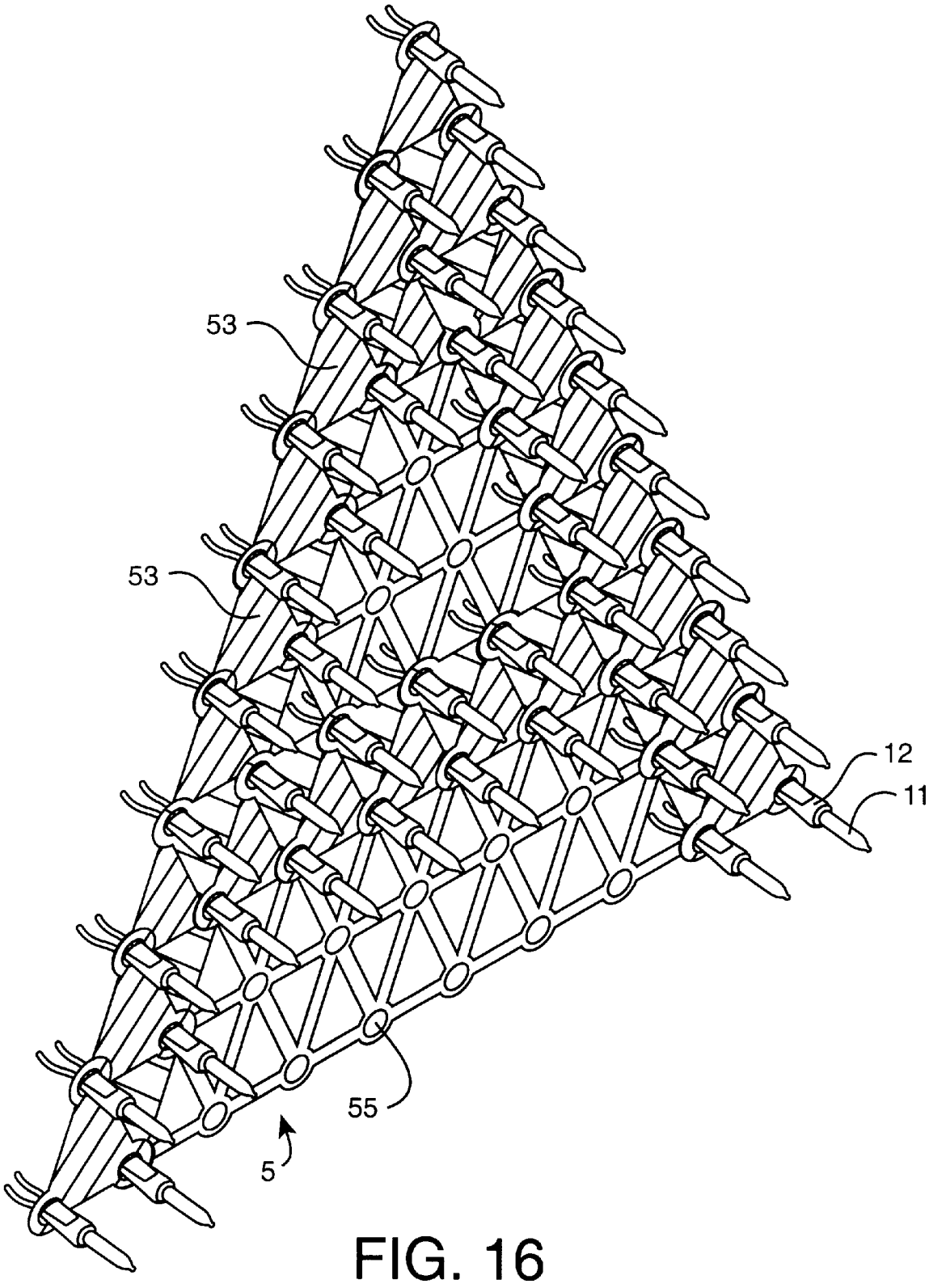
FIG. 16 is an embodiment of an electrical circuit distribution structure in triangular unit to form an A-type design of the present invention.
Figure 16A:
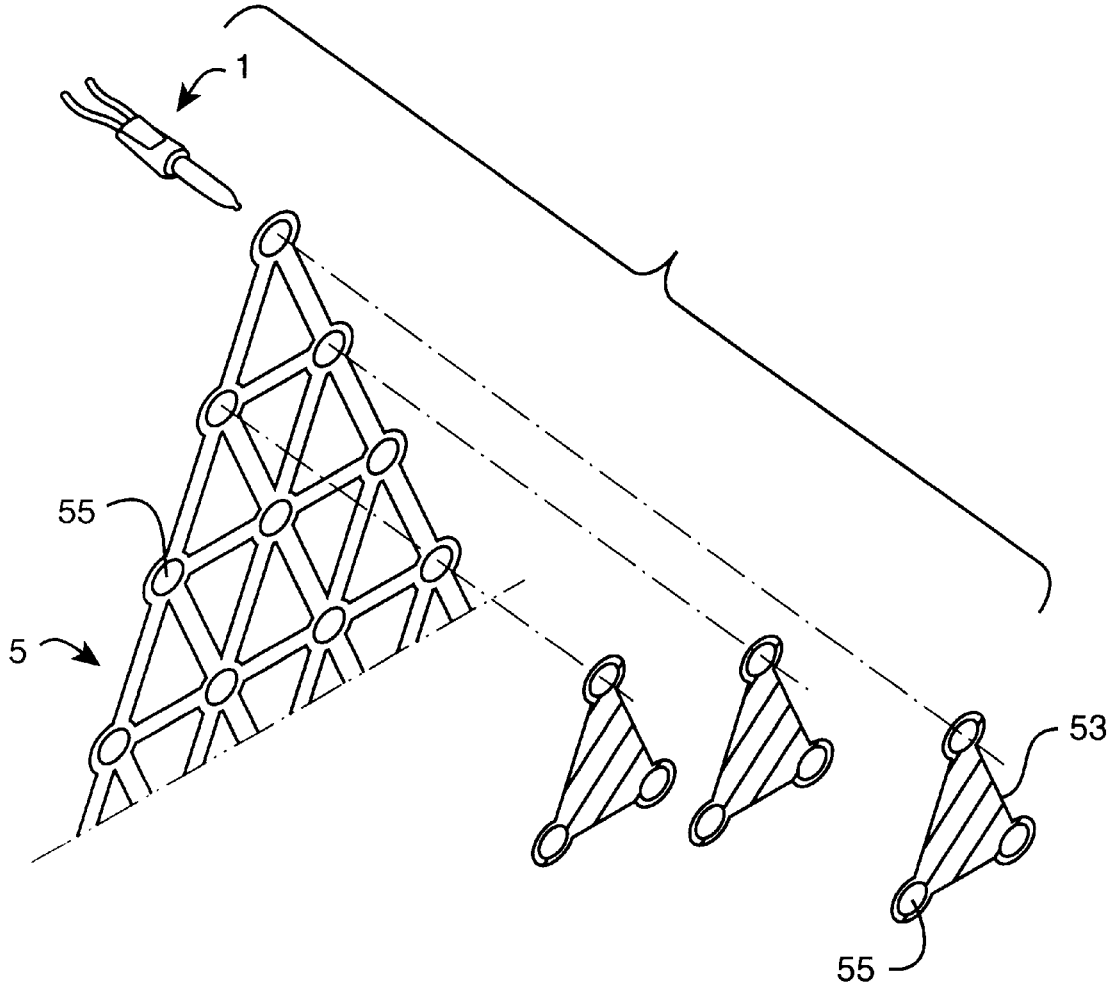
FIG. 16A is a partial diagram of distribution.
Figure 17:
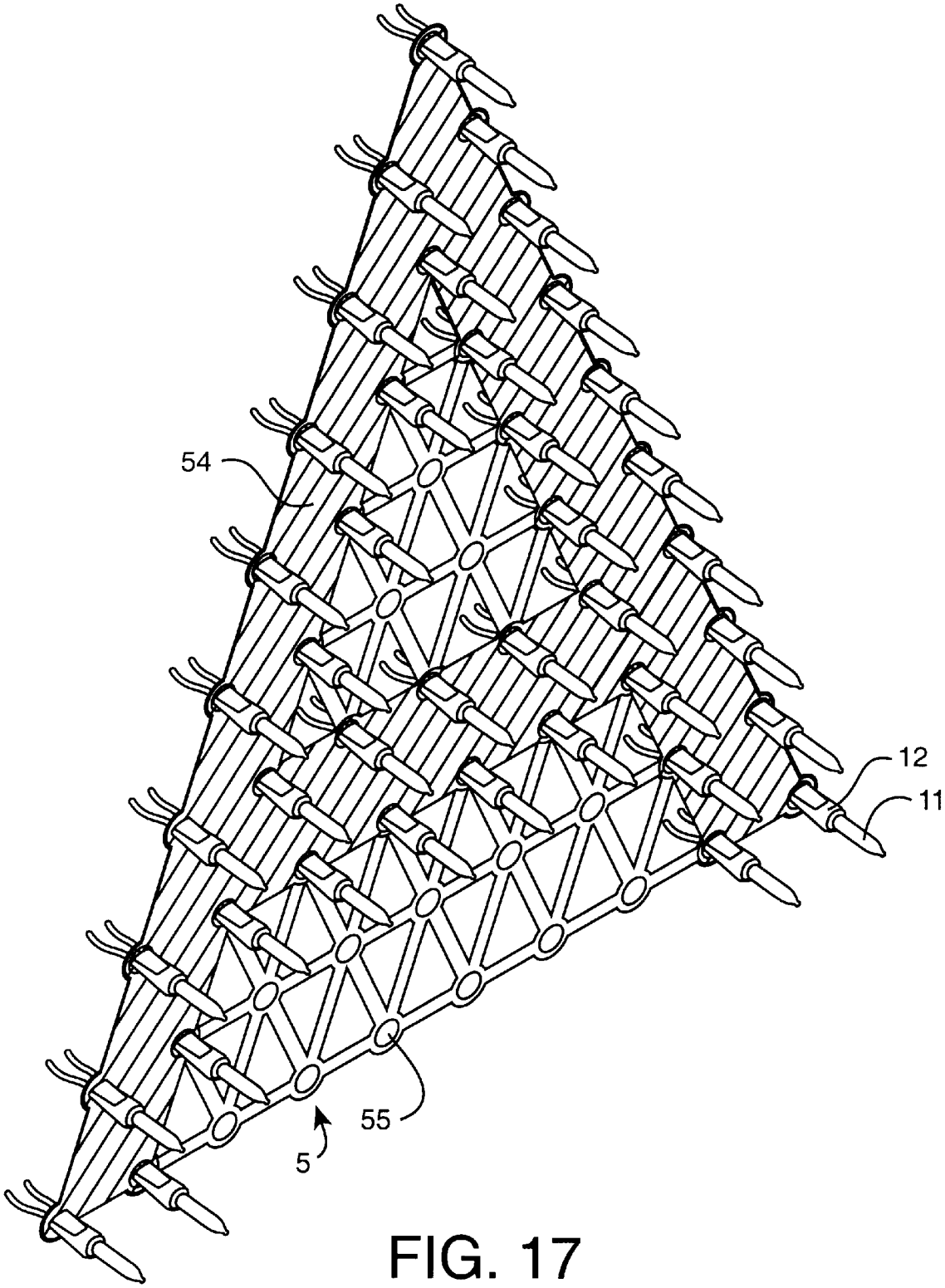
FIG. 17 is a further embodiment of an electrical circuit distribution structure in triangular unit to form an A-type design of the present invention.
Figure 17A:
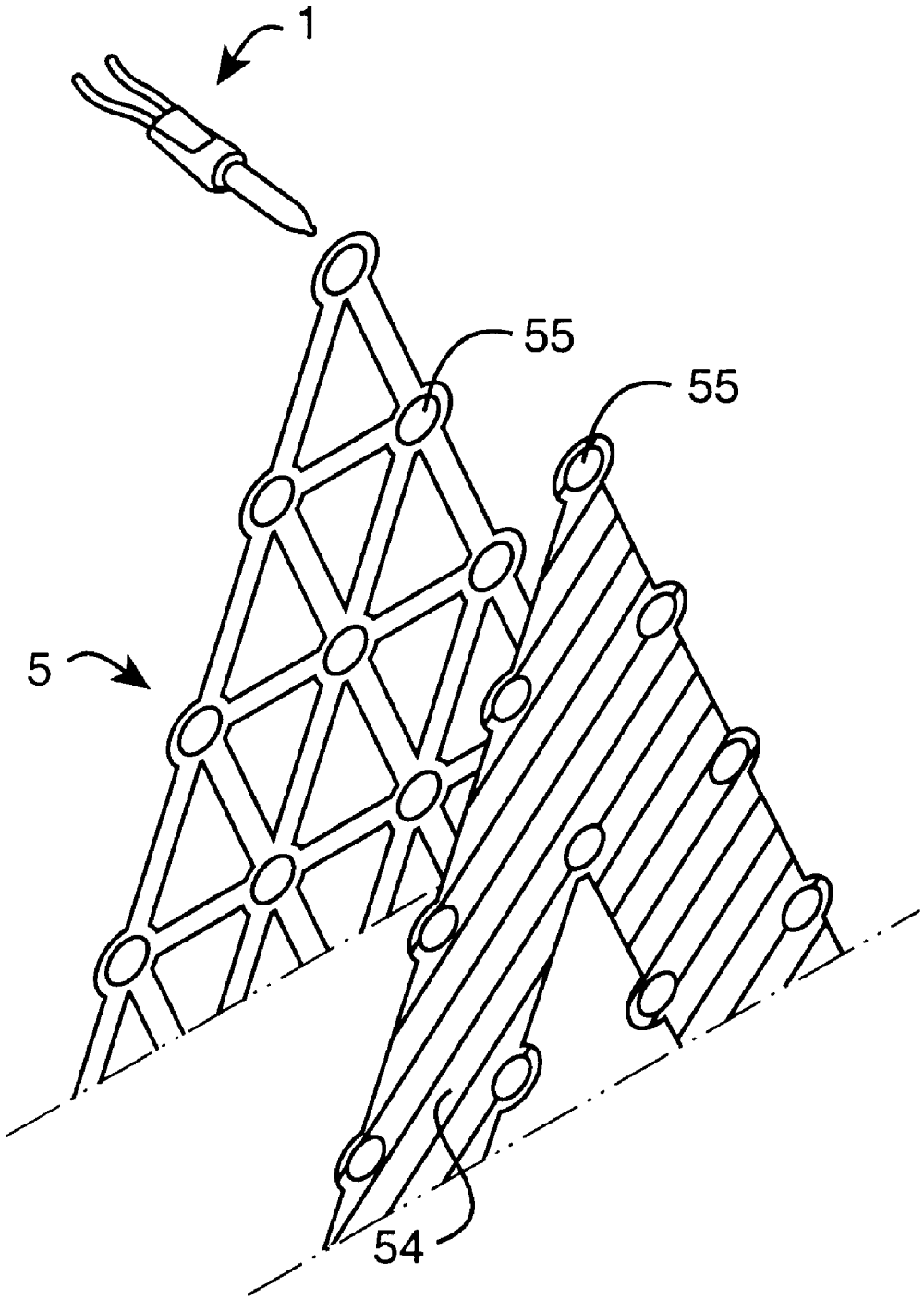
FIG. 17A is a partial diagram of distribution.
Figure 18:
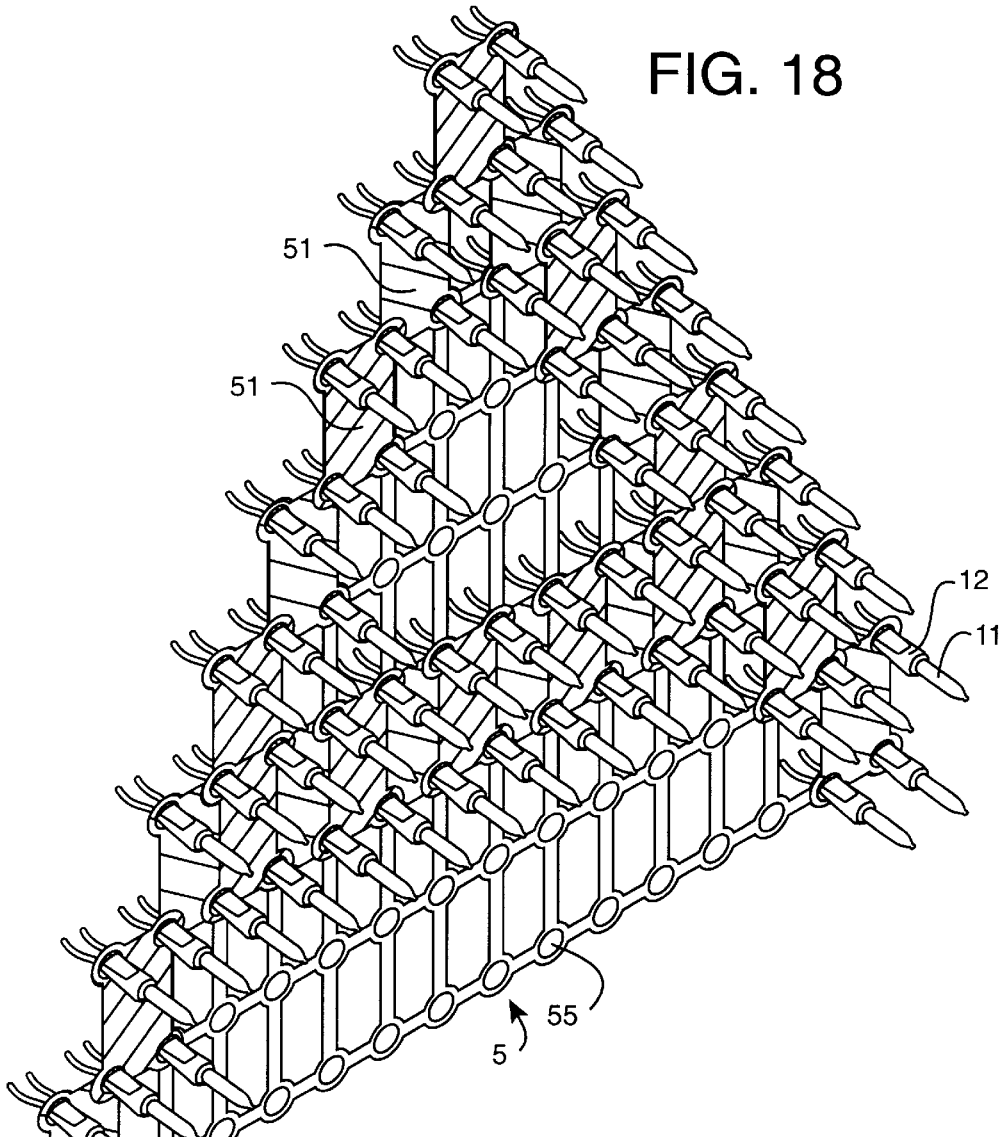
FIG. 18 is an embodiment of an electrical circuit distribution structure in square unit to form an A-type design of the present invention.
Figure 18A:
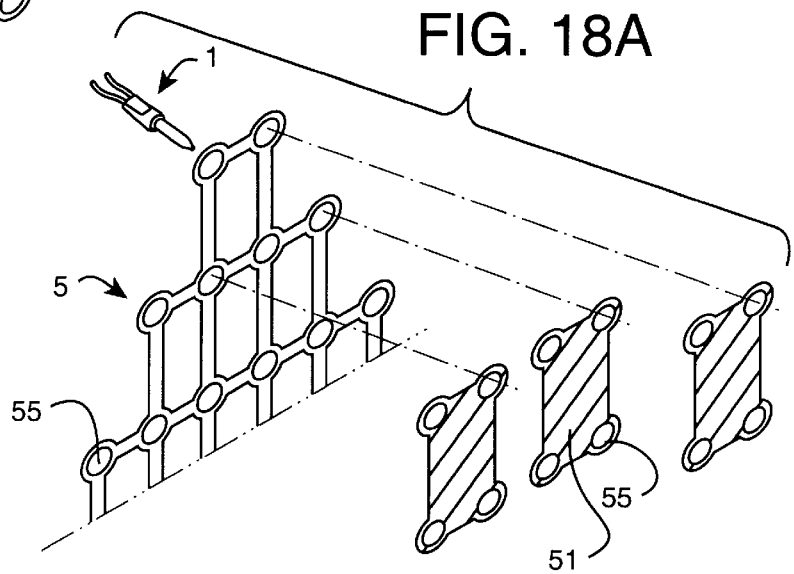
FIG. 18A is a partial diagram of distribution.
Figure 19:
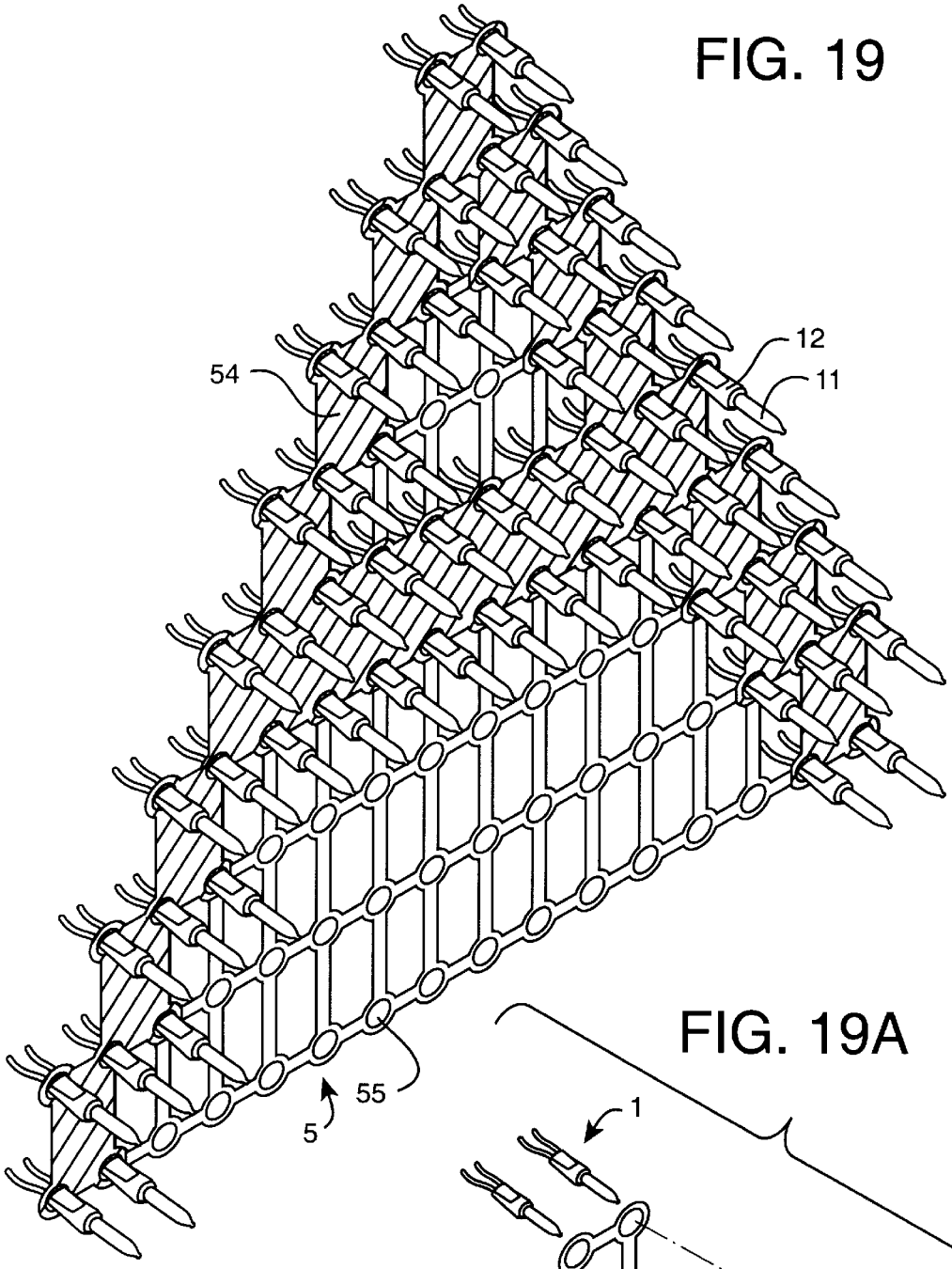
FIG. 19 is a further embodiment of an electrical circuit distribution structure in square unit to form an A-type design of the present invention.
Figure 19A:
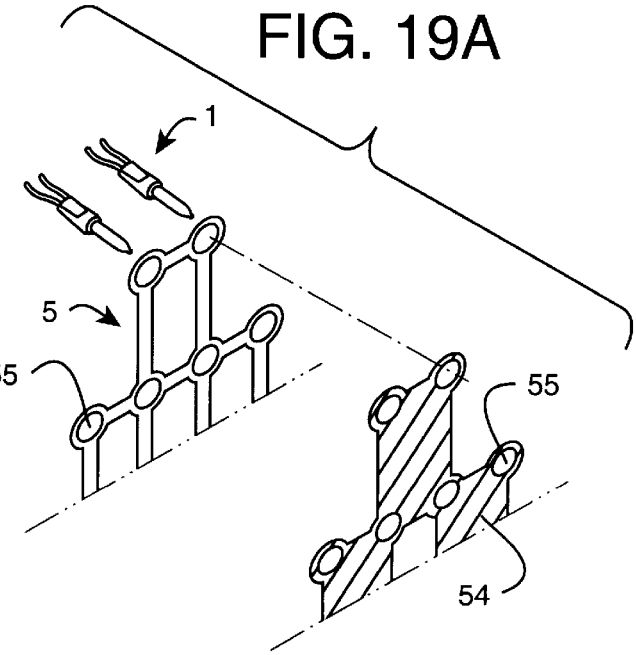
FIG. 19A is a partial diagram of distribution.

FIG. 13 is to use non-electrical connector attached decoration, such as golden scallions, to form non-electrical connectors with decoration 23. Such decorations accompanied in the structure of the present invention will be increasing decorative effect.

FIGS. 14, 14A, 15 and 15A are to use decorative sheets 5 with elasticity. The said decorative sheets are having several holes 55 and the diameter of the hole is slightly small than outer diameter of lamp base or lamp holder 12; or the rhombic decorative sheets 52 are used, and their four corners respectively make holes 55; or whole bulk of A-type decorative sheets are used, and a rhombic is formed between four holes, the intervals of said holes are same as those of lamp bulbs 11 of rhombic unit 32 of lighting string. Each of hole 55 in the decorative sheets 5 is put in the corresponding lamp bulbs 11 and lamp bases or lamp holders 12, and the decorative sheets 5 are fastened and fixed between the lamp bases or lamp holders 12 and electrical conductors 13, or non-electrical connectors 21 or non-electrical connectors 22 (the symbol of 13, 21 and 22 not shown in the drawings). Thus A-type design is the combination of single layer such as decorative 5 or rhombic decorative sheet 52, or multiple layers such as decorative sheet 5 and rhombic decorative sheet 52, the same or different color decorative sheets.

FIGS. 16, 16A, 17 and 17A are to use decorative sheets 5 with elasticity. The said decorative sheets are having several holes 55 and the diameter of the hole is slightly small than the outer diameter of lamp base or lamp holder 12; or the triangular decorative sheets 53 are used, and their three corners respectively make holes 55; or whole bulk of A-type decorative sheets 54 are used, and a triangle is formed between three holes. The intervals of said holes are same as those of lamp bulbs 11 or lamp bases or lamp holders 12 of the triangular unit 33 of lighting string. Each of hole 55 in the decorative sheets 5 is put in the corresponding lamp bulbs 11 and lamp bases or lamp holders 12, and the decorative sheets 5 are fastened and fixed between the lamp bases or lamp holders 12 and electrical conductors 13, or non-electrical connectors 21 or non-electrical connectors 22 (the symbol of 13, 21 and 22 not shown in the drawings). Thus A-type design is the combination of single layer such as decorative 5 or rhombic decorative sheet 52, or multiple layers such as decorative sheet 5 and rhombic decorative sheet 52, the same or different color decorative sheets.

FIGS. 18, 18A, 19 and 19A are to use decorative sheets 5 with elasticity. The said decorative sheets are having several holes 55 and the diameter of the hole is slightly small than the outer diameter of lamp base or lamp holder 12; or the square decorative sheets 54 are used, and their four corners respectively makes holes 55; or whole bulk of A-type decorative sheets 54 are used, and a square is formed between their four holes. The intervals of said holes are same as those of lamp bulbs 11 or lamp bases or lamp holders 12 of the square unit 31 of lighting string. Each of hole 55 in the decorative sheets 5 is put in the corresponding lamp bulbs 11 and lamp bases or lamp holders 12, and the decorative sheets 5 are fastened and fixed between the lamp bases or lamp holders 12 and electrical connectors 13, or non-electrical connectors 22 (the symbol of 13, 21 and 22 not shown in the drawings). Thus A-type design is the combination of single layer such as decorative 5 of rhombic decorative sheet 52. or multiple layers such as decorative sheet 5 and rhombic decorative sheet 52. the same or different color decorative sheets.

Figure 20:
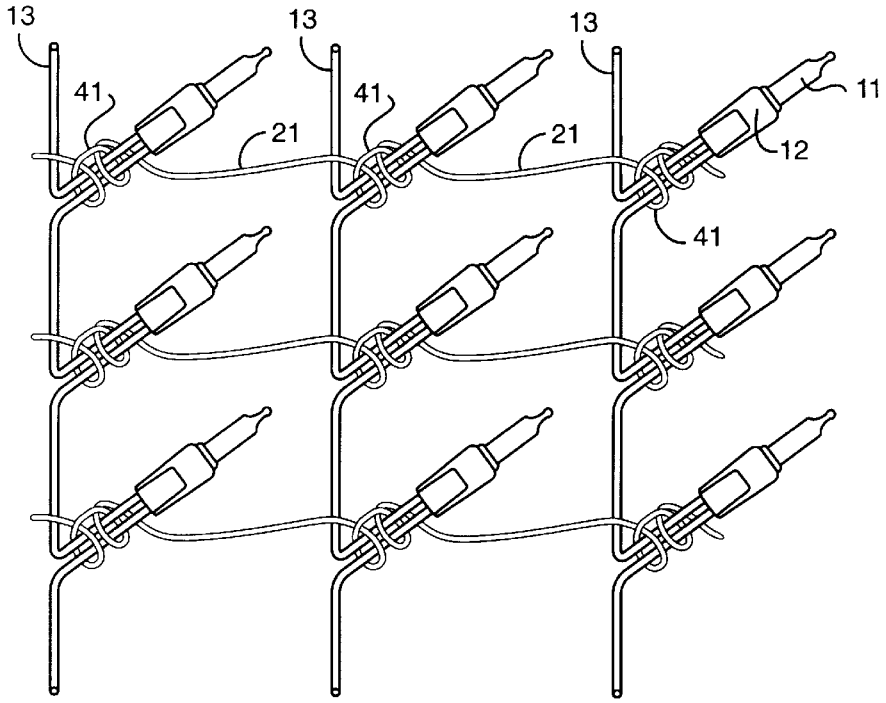
FIGS. 20, 21, 22, 23, 24, 25 and 26 are the diagrams of electrical circuit distribution structures to use non-electrical connectors to form knots of the present invention.
Figure 21:
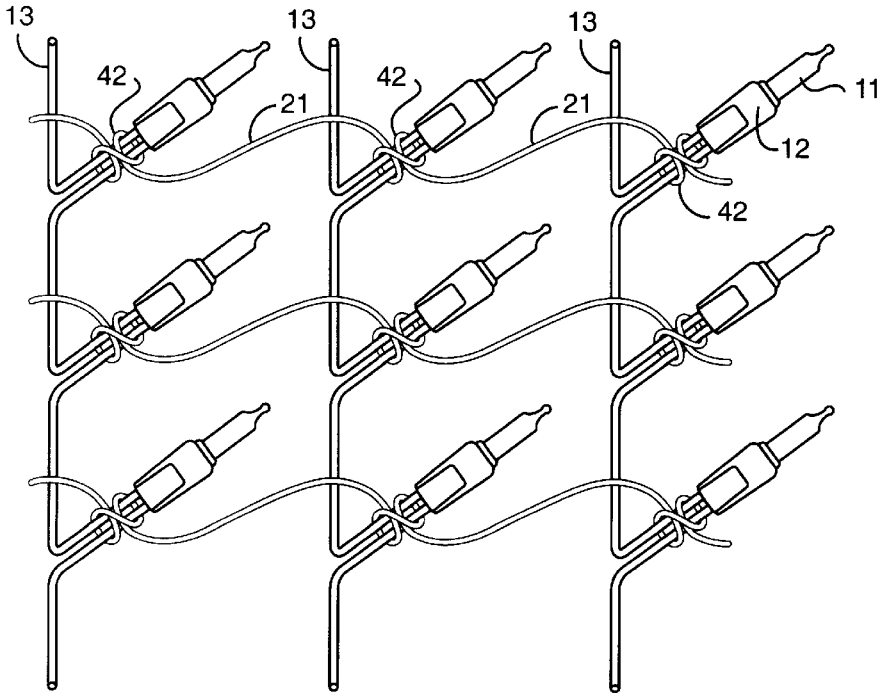
Figure 22:
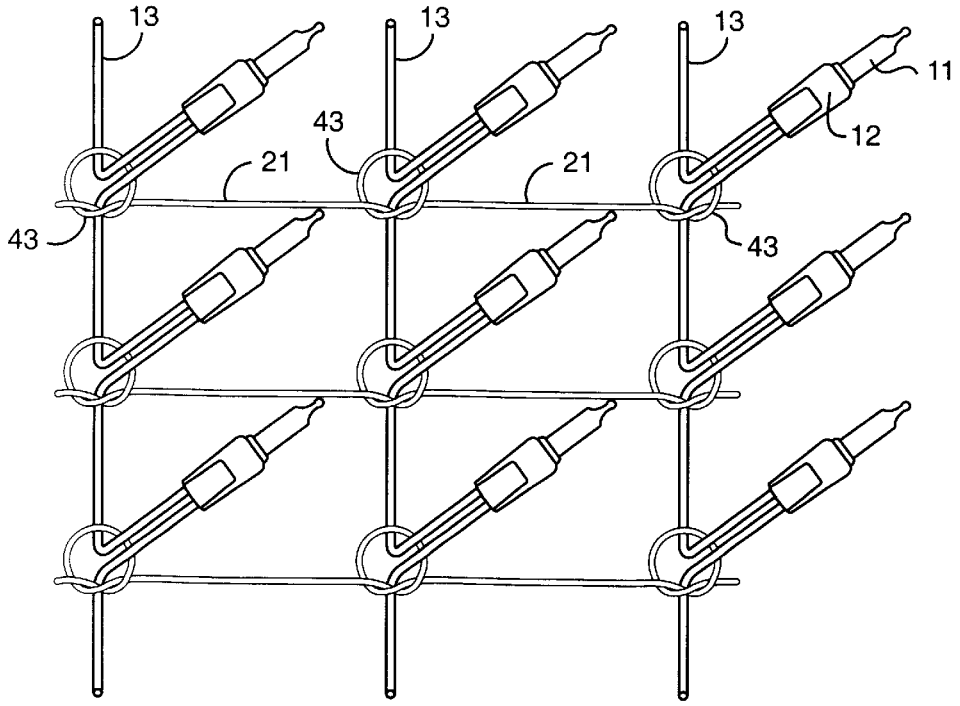
Figure 23:
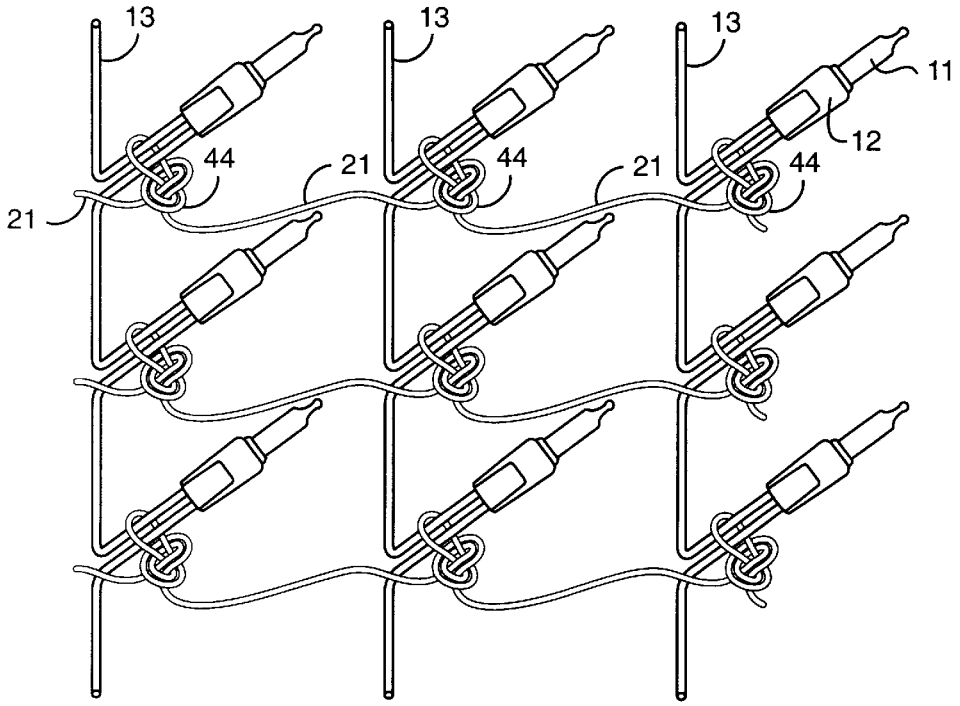
Figure 24:
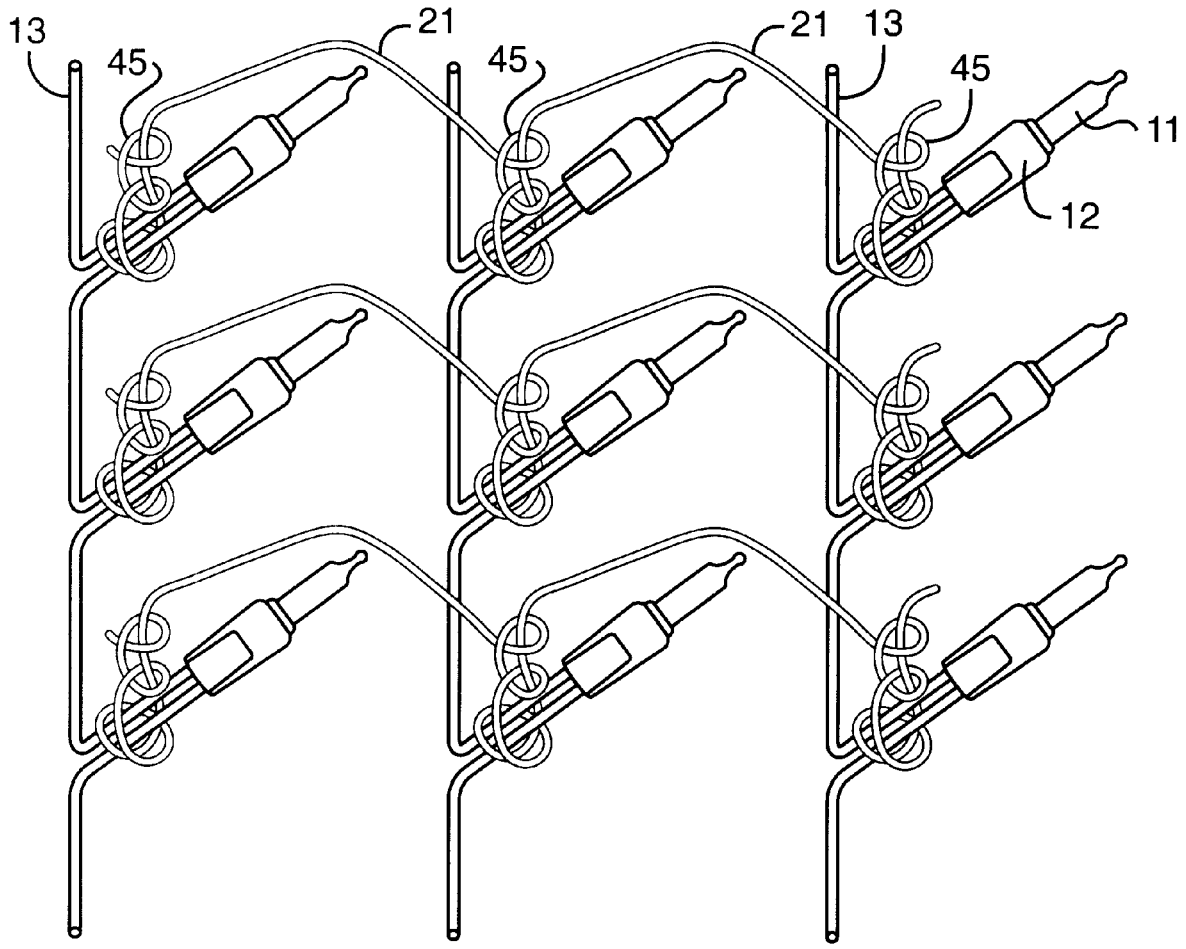
Figure 25:
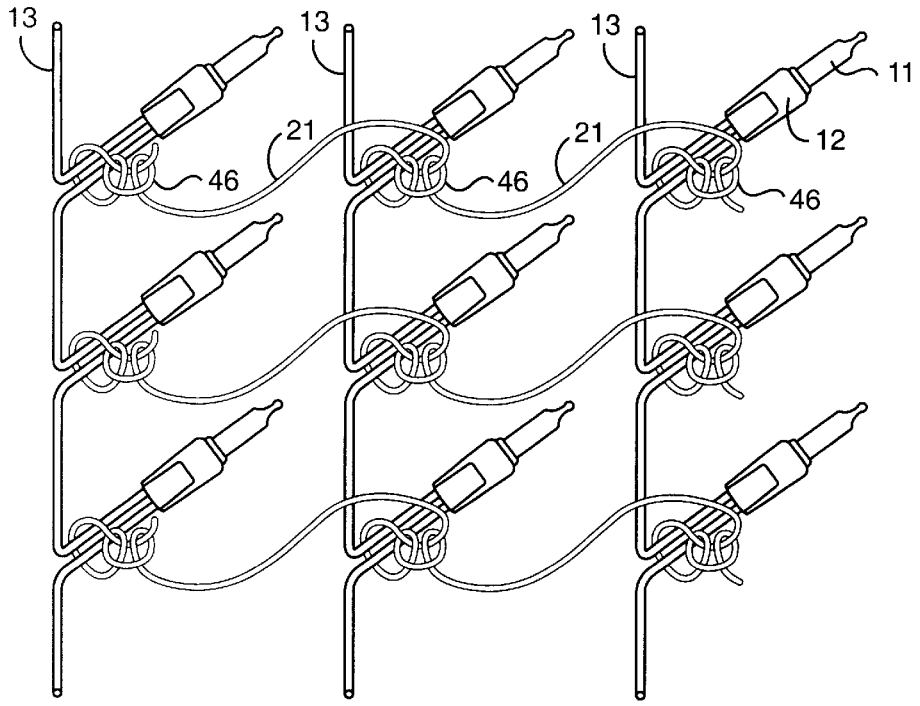
Figure 26:
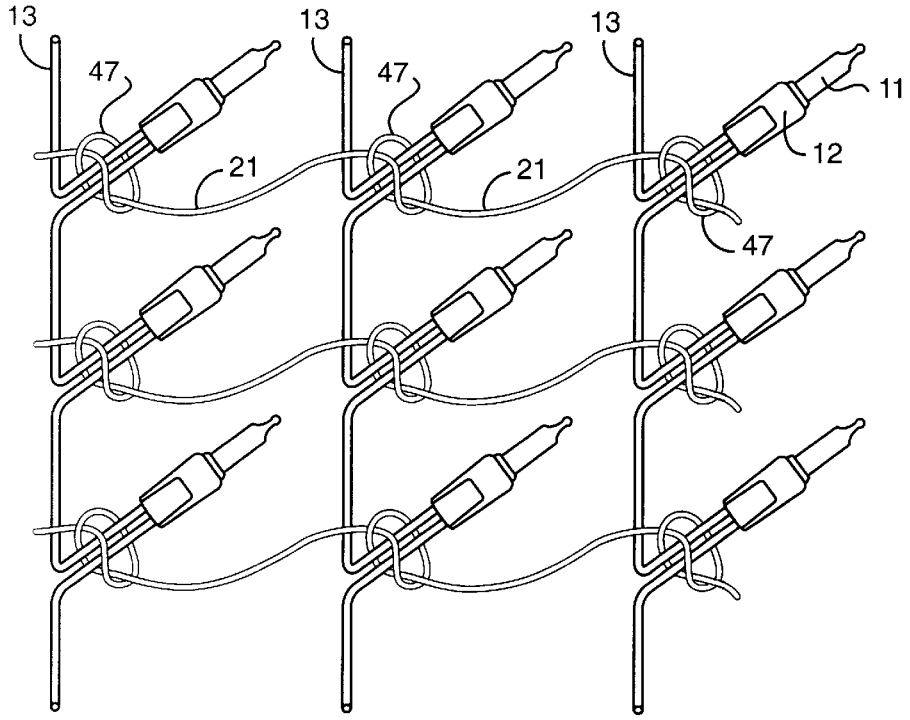

Further, the methods for making knots are various. For the convenience of reference, there are seven kinds of methods to be introduced in the present invention. in sequence, FIG. 20 is a cow hitch, FIG. 21 is a clove hitch. FIG. 22 is a half knot, FIG. 23 is a loop knot, FIG. 24 is a fisherman's bend, FIG. 25 is a sailor's hitch or FIG. 26 is a marlinespike hitch.

The features and preferred embodiments of the present invention have been described in the foregoing specification. The invention intended to be protected herein, however, is not to be construed as limited to the particular forms disclosed. Variations and changes which may be made by those skilled in the art are with out departing from the scope of the present invention.

Symbol Lists

1 lighting string
- 11 lamp bulb
- 12 lamp base or lamp holder
- 13 electrical conductors
- 14 attachment plug
- 15 cord connector body
- 16 flasher control

2 non-electrical conductor
- 21 non-electrical conductor which is not to wind with electrical conductors
- 22 non-electrical conductor which is to wind with electrical conductors
- 23 non-electrical conductors with decoration

3 unit
- 31 rectangular or square unit
- 32 rhombic unit
- 33 triangular unit

4 knot
- 41 cow hitch
- 42 clove hitch
- 43 half knot
- 44 loop knot
- 45 fisherman's bend
- 46 sailor's hitch
- 47 marlinespike hitch

5 decorative sheet
- 51 rectangular or square decorative sheet
- 52 rhombic decorative sheet
- 53 triangular decorative sheet
- 54 A-type decorative sheet
- 55 hole

What I claimed is:

1. An electrical circuit distribution structure for a decorative lighting string, the structure comprising:

a plurality of lamps;

a plurality of electrical conductors electrically connecting said plurality of lamps;

a non-electrical connector connecting said plurality of lamps;

a plurality of golden scallions attached to said non-electrical connector to form decorations on said non-electrical connector.

2. The structure in accordance with claim 1, wherein:

said plurality of lamps include one of lamp bulbs, lamp bases and lamp holders;

a plurality of receptacles are connected to said plurality of electrical conductors;

a flasher control is connected to said plurality of electrical conductors;

said plurality of electrical conductors connect said plurality of lamps in one of a series, a parallel, or a series and parallel arrangement;

said electrical conductors and non-electrical connector connect said plurality of lamps in one of a plurality of triangular, rhombic, rectangular and square units, said units being connected and arranged into one of an appearance, a design and a word to obtain a decorative effect.

3. An electrical circuit distribution structure for a decorative lighting string, the structure comprising:

a plurality of electrical lines;

a plurality of lamps electrically connected to said plurality of electrical lines;

a non-electrical line intersecting with said plurality of electrical lines to form a grid including a plurality of intersection points where said plurality of electrical lines intersect said non-electrical line, a majority of said intersection points including one of said plurality of lamps, said non-electrical line and one of said electrical lines being wound and twisted together, said non-electrical line extending along a same direction as said one electrical line.

4. The structure in accordance with claim 3, wherein:

said non-electrical line extends angularly away from said electrical line at said intersection points.

5. The structure in accordance with claim 3, further comprising:

another non-electrical line intersecting with said non-electrical line to also form said grid.

6. The structure in accordance with claim 3, wherein:

said electrical lines and said non-electrical line are substantially similar in size, color and appearance.

7. The structure in accordance with claim 3, wherein:

said non-electrical line is tied to said electrical lines with a knot at said intersection points.

8. The structure in accordance with claim 3, wherein:

said electrical lines and said non-electrical line cross each other in one of vertical, horizontal, and inclined directions to form a geometric pattern in said grid.

9. The structure in accordance with claim 3, wherein:

all intersection points within said grid include one of said plurality of lamps.

10. The structure in accordance with claim 3, further comprising:

a plurality of decorative sheets defining holes, said holes being arranged substantially similar to an arrangement of said intersection points, each of said holes receiving one of said lamps to connect a respective said lamp to a respective said decorative sheet.

11. The structure in accordance with claim 10, wherein:

said plurality of decorative sheets are substantially identical.

12. The structure in accordance with claim 10, wherein:

said plurality of decorative sheets are one of triangular, rhombic, rectangular, square or irregular shaped.

13. The structure in accordance with claim 3, wherein:

said grid includes a repeating pattern of substantially identical shapes.

14. The structure in accordance with claim 13, wherein:

said shapes are completely formed by said electrical and non-electrical lines.

15. The structure in accordance with claim 13, wherein:

said shapes are formed by said electrical and non-electrical lines.

16. The structure in accordance with claim 13, wherein:

said shapes are one of square, rectangular, triangular, and rhombic.

17. An electrical circuit distribution structure for a decorative lighting string, the structure comprising:

a plurality of electrical lines;

a non-electrical line variably connected with said plurality of electrical lines to form a grid including a plurality of intersection points where said plurality of electrical lines intersect said non-electrical line, a location of said intersection points on said non-electrical line being variable to form said grid into many different shapes and patterns;

a plurality of lamps electrically connected to said plurality of electrical lines at said intersection points to be positioned in said different shapes and patterns with said grid.

18. The structure in accordance with claim 17, wherein:

all intersection points within said grid include one of said plurality of lamps.

19. The structure in accordance with claim 17, wherein:

said non-electrical line extends angularly away from said electrical line at said intersection points.

20. The structure in accordance with claim 17, further comprising:

another non-electrical line intersecting with said non-electrical line to also form said grid, said another non-electrical line being twisted around said electrical line.

21. The structure in accordance with claim 17, wherein:

said electrical lines and said non-electrical line are substantially similar in size, color and appearance.

22. The structure in accordance with claim 17, wherein:

said non-electrical line is tied to said electrical lines with a knot at said intersection points.

23. The structure in accordance with claim 17, wherein:

said electrical lines and said non-electrical line cross each other in one of vertical, horizontal, and inclined directions to form a geometric pattern in said grid.

24. The structure in accordance with claim 17, wherein:

said grid includes a repeating pattern of substantially identical shapes.

25. The structure in accordance with claim 24, wherein:

said shapes are formed by said electrical and non-electrical lines.

26. The structure in accordance with claim 24, wherein:

said shapes are completely formed by said electrical and non-electrical lines.

27. The structure in accordance with claim 24, wherein:

said shapes are one of square, rectangular, triangular, and rhombic.

28. The structure in accordance with claim 17, further comprising:

a plurality of decorative sheets defining holes, said holes being arranged in a pattern substantially similar to a pattern of said intersection points, each of said holes receiving one of said lamps to connect a respective said lamp to a respective said sheet.

29. The structure in accordance with claim 28, wherein:

said plurality of decorative sheets are substantially identical.

30. The structure in accordance with claim 28, wherein:

said plurality of decorative sheets are one of triangular, rhombic, rectangular, square or irregular shaped.

31. An electrical circuit distribution structure for a decorative lighting string, the structure comprising:

a plurality of electrical lines;

a plurality of lamps electrically connected to said plurality of electrical lines in one of a series and a series/parallel arrangement;

a non-electrical line intersecting with said plurality of electrical lines to form a grid including a plurality of intersection points where said plurality of electrical lines intersect said non-electrical line, a majority of said intersection points including one of said plurality of lamps, said electrical line and said non-electrical line being wound and twisted together to form the lighting string.

32. The structure in accordance with claim 31, wherein:

all intersection points within said grid include one of said plurality of lamps.

33. The structure in accordance with claim 31, wherein:

said non-electrical line extends angularly away from said electrical line at said intersection points.

34. The structure in accordance with claim 31, wherein:

said electrical lines and said non-electrical line are substantially similar in size, color and appearance.

35. The structure in accordance with claim 31, wherein:

said non-electrical line is tied to said electrical lines with a knot at said intersection points.

36. The structure in accordance with claim 31, wherein:

said electrical lines and said non-electrical line cross each other in one of vertical, horizontal, and inclined directions to form a geometric pattern in said grid.

37. The structure in accordance with claim 31, wherein:

said grid includes a repeating pattern of substantially identical shapes.

38. The structure in accordance with claim 37, wherein:

said shapes are formed by said electrical and non-electrical lines.

39. The structure in accordance with claim 37, wherein:

said shapes are completely formed by said electrical and non-electrical lines.

40. The structure in accordance with claim 37, wherein:

said shapes are one of square, rectangular, triangular, and rhombic.

41. The structure in accordance with claim 31, further comprising:

a plurality of decorative sheets defining holes, said holes being arranged substantially similar to an arrangement of said intersection points, each of said holes receiving one of said lamps to connect a respective said lamp to a respective said decorative sheet.

42. The structure in accordance with claim 41, wherein:

said plurality of decorative sheets are substantially identical.

43. The structure in accordance with claim 41, wherein:

said plurality of decorative sheets are one of triangular, rhombic, rectangular, square or irregular shaped.

44. An electrical circuit distribution structure for a decorative lighting string, the structure comprising:

a plurality of electrical lines;

a non-electrical line variably connected with said plurality of electrical lines to form a grid including a plurality of intersection points where said plurality of electrical lines intersect said non-electrical line, a location of said intersection points on said non-electrical line being variable to form said grid into many different shapes and patterns, said electrical line and said non-electrical line being wound and twisted together to form the lighting string;

a plurality of lamps electrically connected to said plurality of electrical lines at said intersection points to be positioned in said different shapes and patterns with said grid, said plurality of lamps are connected to said plurality of electrical lines in one of a series and a series/parallel arrangement.

45. The structure in accordance with claim 44, wherein:

all intersection points within said grid include one of said plurality of lamps.

46. The structure in accordance with claim 44, wherein:

said non-electrical line extends angularly away from said electrical line at said intersection points.

47. The structure in accordance with claim 44, wherein:

said electrical lines and said non-electrical line are substantially similar in size, color and appearance.

48. The structure in accordance with claim 44, wherein:

said non-electrical line is tied to said electrical lines with a knot at said intersection points.

49. The structure in accordance with claim 44, wherein:

said electrical lines and said non-electrical line cross each other in one of vertical, horizontal, and inclined directions to form a geometric pattern in said grid.

50. The structure in accordance with claim 44, wherein:

said grid includes a repeating pattern of substantially identical shapes.

51. The structure in accordance with claim 50, wherein:

said shapes are formed by said electrical and non-electrical lines.

52. The structure in accordance with claim 50, wherein:

said shapes are completely formed by said electrical and non-electrical lines.

53. The structure in accordance with claim 50, wherein:

said shapes are one of square, rectangular, triangular, and rhombic.

54. The structure in accordance with claim 44, further comprising:

a plurality of decorative sheets defining holes, said holes being arranged in a pattern substantially similar to a pattern of said intersection points, each of said holes receiving one of said lamps to connect a respective said lamp to a respective said sheet.

55. The structure in accordance with claim 54, wherein:

said plurality of decorative sheets are substantially identical.

56. The structure in accordance with claim 54, wherein:

said plurality of decorative sheets are one of triangular, rhombic, rectangular, square or irregular shaped.

* * * * *